US007484504B2

(12) United States Patent
Kato et al.

(10) Patent No.: US 7,484,504 B2
(45) Date of Patent: Feb. 3, 2009

(54) AIR-FUEL RATIO CONTROL SYSTEM AND METHOD FOR INTERNAL COMBUSTION ENGINE

(75) Inventors: Naoto Kato, Susono (JP); Shuntaro Okazaki, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/858,283

(22) Filed: Sep. 20, 2007

(65) Prior Publication Data

US 2008/0066727 A1 Mar. 20, 2008

(30) Foreign Application Priority Data

Sep. 20, 2006 (JP) ..... 2006-253936

(51) Int. Cl.
*F02D 41/00* (2006.01)
*B60T 7/12* (2006.01)

(52) U.S. Cl. ..... 123/672; 123/674; 701/103; 701/108; 60/277

(58) Field of Classification Search ..... 123/434, 123/672, 703, 674, 696; 701/103, 104, 108, 701/113; 60/277, 285, 289
See application file for complete search history.

(56) References Cited

U.S. PATENT DOCUMENTS 7,117,665 B2 * 10/2006 Kamoto et al. ..... 60/277
2002/0007627 A1 * 1/2002 Hashimoto ..... 60/277
2003/0154953 A1 * 8/2003 Yasui ..... 123/205
2004/0045282 A1 * 3/2004 Ide et al. ..... 60/285
2005/0217243 A1 * 10/2005 Kamoto et al. ..... 60/277
2006/0282211 A1 * 12/2006 Yasui ..... 701/103

FOREIGN PATENT DOCUMENTS

JP 2003-049685 A 2/2003
JP 2005-113729 A 4/2005

* cited by examiner

*Primary Examiner*—John T Kwon
(74) *Attorney, Agent, or Firm*—Sughrue Mion, PLLC

(57) ABSTRACT

An air-fuel ratio control system includes: a catalyst; an oxygen concentration sensor; an integral value calculation portion that calculates an integral value of a deviation updated by integrating the deviation between an output value from the oxygen concentration sensor and a reference value; an air-fuel ratio control portion that controls an air-fuel ratio of exhaust gas entering the catalyst to be equal to a target air-fuel ratio; a target air-fuel ratio switching portion that sets a rich target air-fuel ratio when the output value has been inverted from rich to lean while sets a lean target air-fuel ratio when the output value has been inverted from lean to rich; and an integral value correction portion that corrects the integral value of the deviation when the air-fuel ratio is being controlled to a switched target air-fuel ratio, based on whether the next inversion takes place within a predetermined time period from the last inversion.

25 Claims, 14 Drawing Sheets

AIR-FUEL RATIO CONTROL SYSTEM AND METHOD FOR INTERNAL COMBUSTION ENGINE

INCORPORATION BY REFERENCE

The disclosure of Japanese Patent Application No. 2006-253936 filed on Sep. 20, 2006 including the specification, drawings and abstract is incorporated herein by reference in its entirety.

BACKGROUND OF THE INVENTION

1. Field of the Invention

The invention relates to an air-fuel ratio control system and an air-fuel ratio control method for an internal combustion engine that control the air-fuel ratio of exhaust gas entering a catalyst.

2. Description of the Related Art

For example, Japanese Patent Application Publication No. 2005-113729 (JP-A-2005-113729) recites an air-fuel ratio control system for an internal combustion engine. This air-fuel ratio control system has an upstream-side air-fuel ratio sensor provided upstream of a catalyst in the exhaust passage of the internal combustion engine and a downstream-side air-fuel ratio sensor (electromotive force type oxygen sensor) provided downstream of the catalyst. According to this air-fuel ratio control system, a feedback correction amount is calculated by performing a proportional integral derivative processing (so-called PID processing) to the deviation between the output value of the downstream-side air-fuel ratio sensor and the target value of the same output value (which corresponds to the target air-fuel ratio). This deviation will be referred to as "downstream-side deviation" where necessary. Then, the output value of the upstream-side air-fuel ratio sensor is corrected using the feedback correction amount calculated as above, and feedback control is performed on the amount of fuel injected from the injector using the corrected output value of the upstream-side air-fuel ratio sensor such that the air-fuel ratio equals the target air-fuel ratio.

In general, for example, a deviation unavoidably arises between the intake air flow rate detected by an airflow meter, which is used to determine the amount of fuel to be injected from the injector, and the actual intake airflow rate (the variation of detection by the airflow meter), and a deviation unavoidably arises between the required fuel injection amount that the injector is required to inject and the amount of fuel actually injected (the variation of injection from the injector). Such deviations will be collectively referred to as "error of fuel injection amount". Further, the output value of a limiting-current type oxygen sensor that is typically used as the upstream-side air-fuel ratio sensor tends to include an error. Hereinafter, the error of fuel injection amount and the error of the upstream-side air-fuel ratio sensor will be collectively referred to as "error of intake and exhaust system" where necessary.

The aforementioned feedback control amount includes an integral term, that is, a value obtained by multiplying an integral value of the deviation, which is updated by integrating the downstream-side deviation, by a feedback gain. Therefore, even if the error of intake/exhaust system occurs, the error of intake/exhaust system may be compensated for dud to the integral term by performing the foregoing feedback control. As a result, the air-fuel ratio may converge and be made equal to the target air-fuel ratio. In other words, the value of the integral term (or the integral value of the deviation) may be used as a value representing the magnitude of the error of intake/exhaust system.

Such air-fuel ratio control systems perform an integral term learning process in which the value of the integral term (or the integral value of the deviation) as mentioned above is recorded while the recorded value of the integral term (hereinafter, this value will be referred to also as "learning value of the integral term") is repeatedly updated (learned) at given time intervals.

Meanwhile, the value of the integral term (or the learning value of the integral term) converges to the value that accurately represents the magnitude of the error of intake and exhaust system (will be referred to as "target convergence value"). If the value of the integral term (or the learning value of the integral term) is equal to the target convergence value, it indicates that the actual air-fuel ratio which the air-fuel ratio control system treats as an air-fuel ratio equal to the target air-fuel ratio (will be referred to as "control center air-fuel ratio") is actually equal to the target air-fuel ratio. When the control center air-fuel ratio is equal to the target air-fuel ratio, the error of intake and exhaust system may be properly compensated for, and thus the air-fuel ratio may be properly made equal to the target air-fuel ratio.

On the other hand, when the value of the integral term (or the learning value of the integral term) is deviating from the target convergence value, the control center air-fuel ratio becomes a value deviating from the target air-fuel ratio. In this case, there is a possibility that the error of intake and exhaust system may not be properly compensated for and thus the air-fuel ratio may not be properly made equal to the target air-fuel ratio. Therefore, when the control center air-fuel ratio is deviating from the target air-fuel ratio, it is necessary to make the value of the integral term (or the learning value of the integral term) converge to the target convergence value promptly.

According to the air-fuel ratio control system of JP-A-2005-113729, however, the value of the integral term is updated only by integrating the downstream-side deviation each time. Therefore, in particular, when the value of the integral term (or the learning value of the integral term) is largely deviating from the target convergence value, the value of the integral term (or the learning value of the integral term) does not converge to the target convergence value promptly.

SUMMARY OF THE INVENTION

The invention provides an air-fuel ratio control system and an air-fuel ratio control method for an internal combustion engine, which promptly bring the integral value of a deviation (or the value of the integral term), which is used in the air-fuel ratio feedback control executed based on the output of the downstream-side air-fuel ratio sensor, to the target convergence value even when the integral value of the deviation (or the value of the integral term) is largely deviating from the target convergence value, and thus may bring the control center air-fuel ratio to the target air-fuel ratio.

An air-fuel ratio control system according to a first aspect of the invention has a catalyst, an oxygen concentration sensor, an integral value calculation portion, an air-fuel ratio control portion, a target air-fuel ratio switching portion, and an integral value correction portion.

The catalyst is provided in an exhaust passage of the internal combustion engine and has a property of storing oxygen.

The oxygen concentration sensor is provided downstream of the catalyst in the exhaust passage and outputs a value corresponding to the air-fuel ratio of exhaust gas flowing out from the catalyst.

The integral value calculation portion calculates an integral value of a deviation which is updated by integrating the deviation between the value output from the oxygen concentration sensor and a reference value corresponding to a target air-fuel ratio.

The air-fuel ratio control portion controls an air-fuel ratio of exhaust gas entering the catalyst to be equal to the target air-fuel ratio based on at least the integral value of the deviation.

The target air-fuel ratio switching portion switches the target air-fuel ratio such that a rich target air-fuel ratio which is richer than a stoichiometric air-fuel ratio is set when the value output from the oxygen concentration sensor has been inverted from a value indicating a rich air-fuel ratio to a value indicating a lean air-fuel ratio while a lean target air-fuel ratio which is leaner than the stoichiometric air-fuel ratio is set when the value output from the oxygen concentration sensor has been inverted from the value indicating the lean air-fuel ratio to the value indicating the rich air-fuel ratio.

The integral value correction portion that corrects the integral value of the deviation when the air-fuel ratio of exhaust gas entering the catalyst is being controlled to be equal to a target air-fuel ratio switched by the target air-fuel ratio switching portion, based on whether the next inversion of the value output from the oxygen concentration sensor takes place within a predetermined time period after the value output from the oxygen concentration sensor has been inverted.

An air-fuel ratio control method for an internal combustion engine according to a second aspect of the invention includes: calculating an integral value of a deviation which is updated by integrating the deviation between the value output from an oxygen concentration sensor provided downstream of a catalyst in an exhaust passage of the internal combustion engine and a reference value corresponding to a target air-fuel ratio; controlling an air-fuel ratio of exhaust gas entering the catalyst to be equal to the target air-fuel ratio based on at least the integral value of the deviation; switching the target air-fuel ratio such that a rich target air-fuel ratio which is richer than a stoichiometric air-fuel ratio is set when the value output from the oxygen concentration sensor has been inverted from a value indicating a rich air-fuel ratio to a value indicating a lean air-fuel ratio while a lean target air-fuel ratio which is leaner than the stoichiometric air-fuel ratio is set when the value output from the oxygen concentration sensor has been inverted from the value indicating the lean air-fuel ratio to the value indicating the rich air-fuel ratio; and correcting the integral value of the deviation based on whether the next inversion of the value output from the oxygen concentration sensor takes place within a predetermined time period after the value output from the oxygen concentration sensor has been inverted when the air-fuel ratio of exhaust gas entering the catalyst is being controlled to be equal to a switched target air-fuel ratio.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF THE EMBODIMENTS

Hereinafter, an air-fuel ratio control system according to an example embodiment of the invention will be described with reference to the drawings. In the following descriptions, the air-fuel ratio of exhaust gas entering a catalyst will be referred to as "catalyst upstream-side air-fuel ratio" or simply as "air-fuel ratio" where necessary, and an internal combustion engine will be simply referred to as "engine" where necessary.

Figure 1:
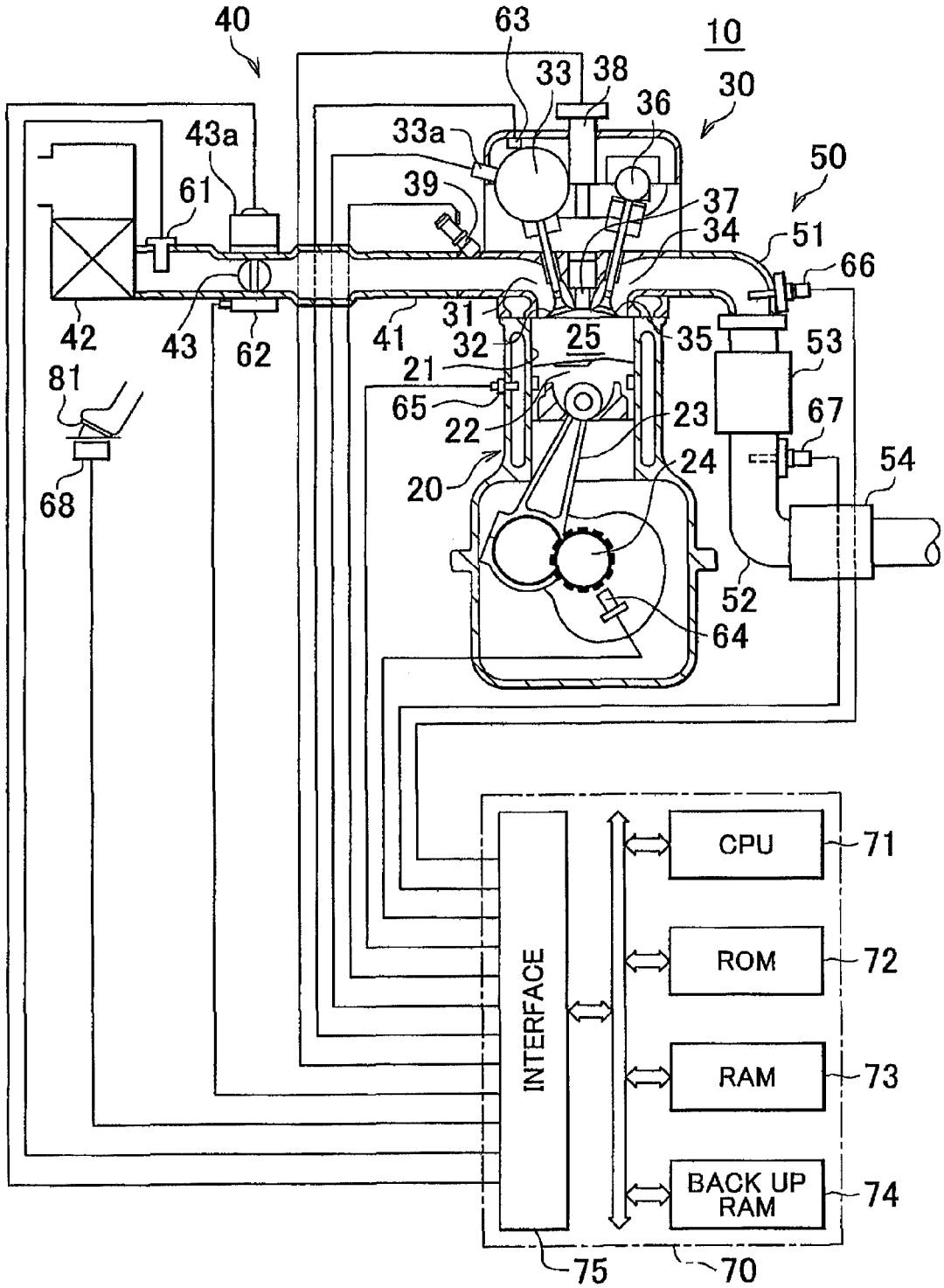
FIG. 1 is a view schematically showing an internal combustion engine incorporating an air-fuel ratio control system according to an example embodiment of the invention.

FIG. 1 schematically shows the configuration of a spark-ignition type multi-cylinder (four-cylinder) internal combustion engine 10 incorporating an air-fuel ratio control system according to an example embodiment of the invention. The internal combustion engine 10 includes: a cylinder block assembly 20 having a cylinder block, a cylinder block lower case, an oil pan, and so on; a cylinder head unit 30 mounted on the cylinder block assembly 20; an intake system 40 that supplies air-fuel mixtures to the cylinder block assembly 20; and an exhaust system 50 that discharges exhaust gas from the cylinder block assembly 20 to the outside.

The cylinder block assembly 20 includes cylinders 21, pistons 22, connecting rods 23, and a crankshaft 24. The pistons 22 reciprocates in the respective the cylinders 21, and the reciprocation of each piston 22 is transferred to the crankshaft 24 via the connecting rods 23, whereby the crankshaft 24 rotates. Combustion chambers 25 are composed of the cylinders 21, the crowns of the pistons 22, and the cylinder head unit 30.

The cylinder head unit 30 is provided with intake ports 31 communicating with the respective combustion chambers 25, intake valves 32 for opening and closing the intake ports 31, an intake camshaft for driving the intake valves 32, a variable intake valve timing device 33 that continuously changes the phase angle of the intake camshaft, an actuator 33*a* of the variable intake valve timing device 33, exhaust ports 34 communicating with the respective combustion chambers 25, exhaust valves 35 for opening and closing the exhaust ports 34, an exhaust camshaft 36 for driving the exhaust valves 35, ignition plugs 37, an igniter 38 having an ignition coil that generates high voltage to be supplied to each ignition plug 37, and injectors (fuel injecting means) 39 that inject fuel into the respective intake ports 31.

The intake system 40 is provided with an intake pipe 41 including an intake manifold communicating with the respective intake ports 31 and thus forming the intake passage together with the intake ports 31, an air filter 42 provided at one end of the intake pipe 41, a throttle valve 43 provided in the intake pipe 41 to variably change the opening area of the intake passage, and a throttle-valve actuator 43*a*. The intake ports 31 and the intake pipe 41 together form the intake passage.

The exhaust system 50 is provided with an exhaust manifold 51 communicating with the respective exhaust ports 34, an exhaust pipe 52 connected to the exhaust manifold 51 (to the point to which the branch pipes of the exhaust manifold 51 communicating with the respective exhaust ports 34 converge), an upstream catalyst unit 53 provided in the exhaust pipe 52 (three-way catalyst, will be referred to as "first catalyst 53"), and a downstream catalyst unit 54 (three-way catalyst, will be referred to as "second catalyst 54"). The exhaust ports 34, the exhaust manifold 51, and the exhaust pipe 52 together form the exhaust passage.

Further, this system is provided with an air-flow meter 61, a throttle position sensor 62, a cam position sensor 63, a crank position sensor 64, a coolant temperature sensor 65, an air-fuel ratio sensor 66 provided upstream of the first catalyst 53 (at the point to which the branch pipes of the exhaust manifold 51 converge) in the exhaust passage (will be referred to "upstream-side air-fuel ratio sensor 66"), an air-fuel ratio sensor 67 provided downstream of the first catalyst 53 and upstream of the second catalyst 54 in the exhaust passage (will be referred to "downstream-side air-fuel ratio sensor 67"), and an accelerator operation amount sensor 68.

The air-flow meter 61 is a known hot-wire air-flow meter that outputs voltage corresponding to the mass flow rate of intake air flowing through the intake pipe 41 per unit time (intake air flow rate Ga). The throttle position sensor 62 detects the opening degree of the throttle valve 43 and outputs signals indicating the throttle valve opening degree TA. The cam position sensor 63 outputs a pulse (a G2 signal) each time the intake camshaft turns 90° (each time the crankshaft 24 turns 180°). The crank position sensor 64 outputs a narrow pulse each time the crankshaft 24 turns 10° and a wide pulse each time the crankshaft 24 turns 360°. From these signals, an engine speed NE is determined. The coolant temperature sensor 65 detects the temperature of the coolant of the internal combustion engine 10 and outputs signals indicating a coolant temperature THW.

Figure 2:
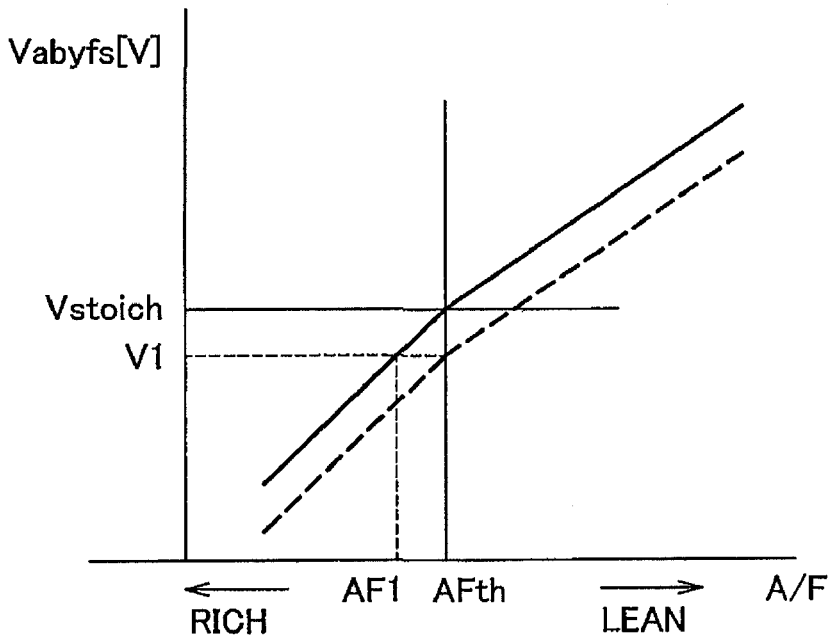
FIG. 2 is a graph illustrating the relation between the output voltage of the upstream-side air-fuel ratio sensor shown in FIG. 1 and the air-fuel ratio.

The upstream-side air-fuel ratio sensor 66 is a limiting-current type oxygen sensor. As shown in FIG. 2, the upstream-side air-fuel ratio sensor 66 outputs current corresponding to the air-fuel ratio A/F and outputs voltage corresponding to the output current and indicating an output value Vabyfs. Assuming that the output value Vabyfs of the upstream-side air-fuel ratio sensor 66 includes no error (will be referred to as "the error of the upstream-side air-fuel ratio sensor 66" where necessary), the output value Vabyfs of the upstream-side air-fuel ratio sensor 66 equals an upstream-side target value Vstoich when the air-fuel ratio is equal to a stoichiometric air-fuel ratio AFth. As is evident from FIG. 2, the upstream-side air-fuel ratio sensor 66 may accurately detect the air-fuel ratio A/F in a wide range.

Figure 3:
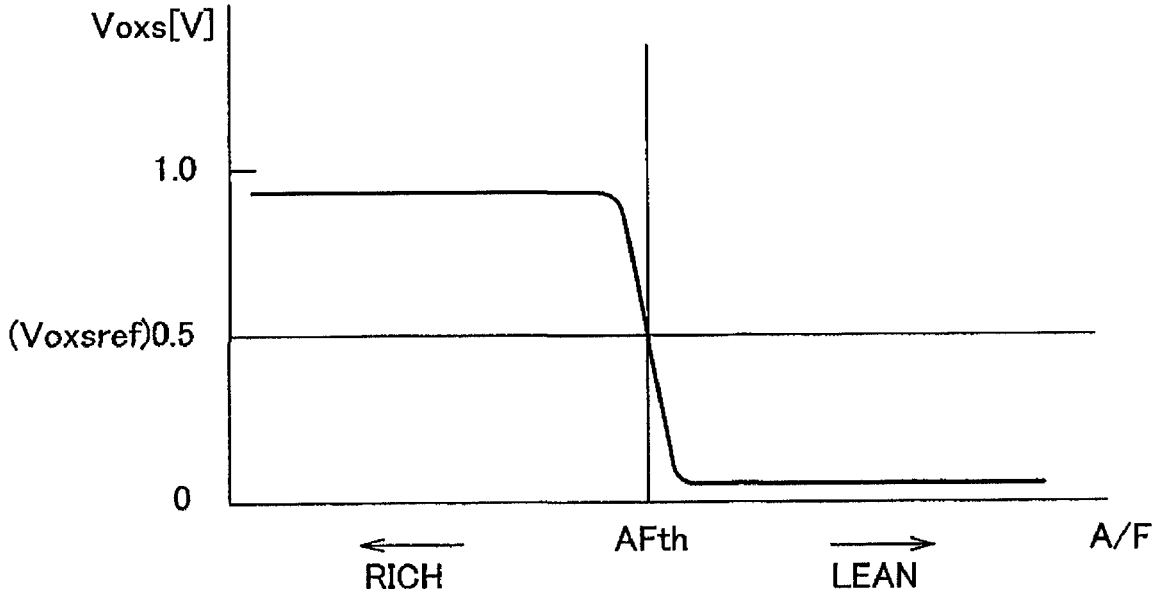
FIG. 3 is a graph illustrating the relation between the output voltage of the downstream-side air-fuel ratio sensor shown in FIG. 1 and the air-fuel ratio.

The downstream-side air-fuel ratio sensor 67 is an electromotive force type oxygen sensor (concentration cell type oxygen sensor) that, as shown in FIG. 3, outputs an output value Voxs that sharply changes near the stoichiometric air-fuel ratio. More specifically, the downstream-side air-fuel ratio sensor 67 outputs; approx. 0.1 V (will be referred to as "lean value") when the air-fuel ratio is fuel-lean; approx. 0.9 V (will be referred to as "rich value") when the air-fuel ratio is fuel-rich; and 0.5 V when the air-fuel ratio is equal to the stoichiometric air-fuel ratio. The accelerator depression amount sensor 68 detects the amount by which the driver depresses the accelerator pedal 81 and outputs signals indicating the depression amount Accp of the accelerator pedal 81.

Further, this system is provided with an electric control unit 70. The electric control unit 70 is a microcomputer of a CPU 71, a ROM 72 where various routines (programs) which is executed by the CPU 71, data tables (e.g., look-up tables, maps), and parameters are being stored beforehand, a RAM 73 where the CPU 71 temporarily stores various data as needed, a back-up RAM (SRAM) 74 where data is stored when powered and the stored data may be held even when not powered, an interface 75 including A/D converters, and so on, which are all connected via communication buses. The interface 75 is connected to the foregoing sensors 61 to 68. The interface 75 supplies the signals of the sensors 61 to 68 to the CPU 71 and outputs drive signals to the actuator 33*a* of the variable intake valve timing device 33, the igniter 38, the injectors 39, and the throttle-valve actuator 43 a in accordance with commands from the CPU 71.

Next, the outline of the air-fuel ratio control executed by the air-fuel ratio control system of the invention configured as described above will be described.

The air-fuel ratio control of the invention includes two feedback controls; an air-fuel ratio feedback control that is executed using the output value of the upstream-side air-fuel ratio sensor 66 (hereinafter, this feedback control will be referred to as "main feedback control"); and an air-fuel ratio feedback control that is executed using the output value of the downstream-side air-fuel ratio sensor 67 (hereinafter, this feedback control will be referred to as "sub-feedback control"). Through these feedback controls, the air-fuel ratio is feedback controlled to be equal to the stoichiometric air-fuel ratio of the target air-fuel ratio.

Figure 4:
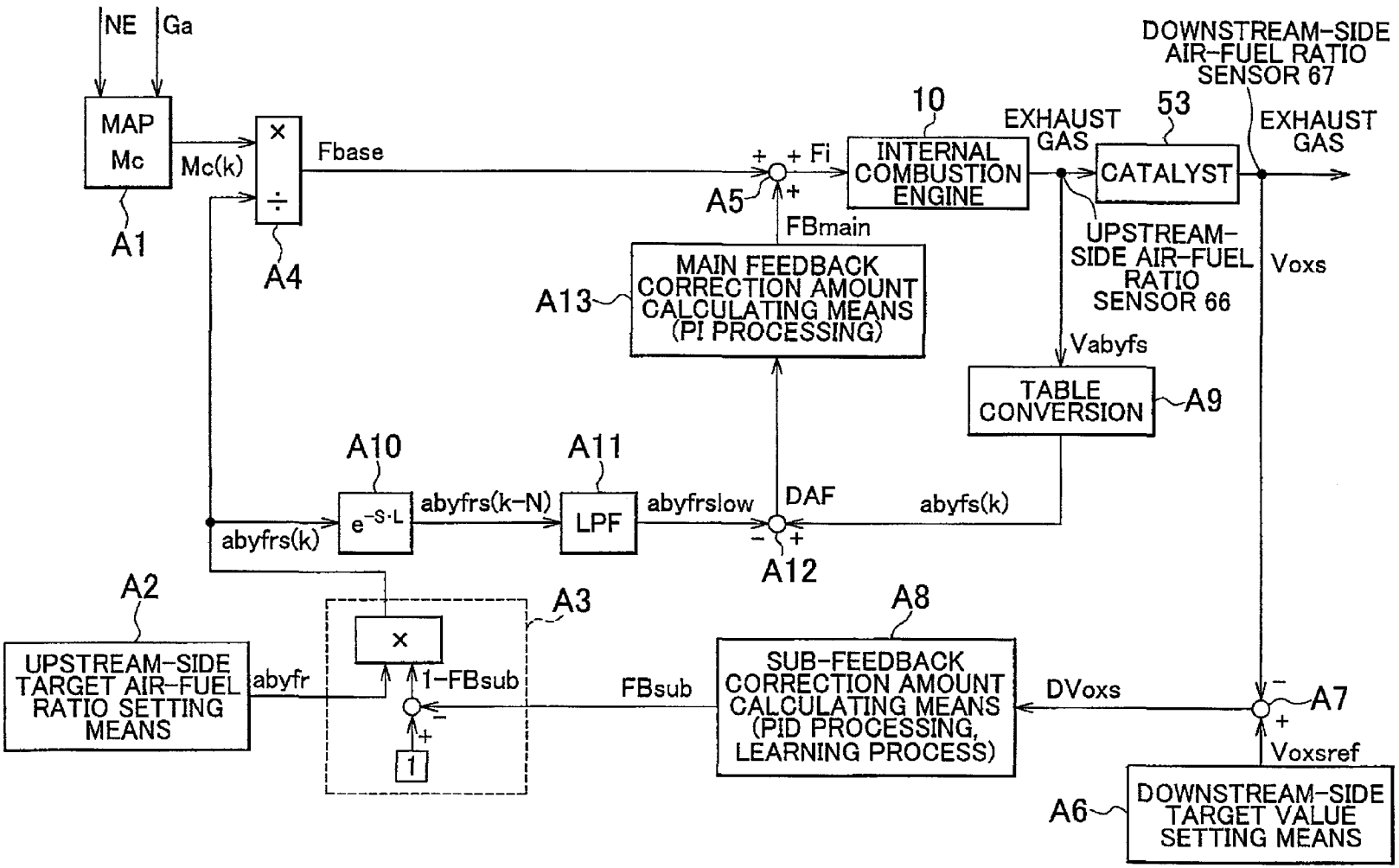
FIG. 4 is a function block diagram illustrating function blocks used when the air-fuel ratio control system shown in FIG. 1 executes the air-fuel ratio feedback control.

More specifically, the air-fuel ratio control system of this example embodiment has function blocks A1 to A13 as illustrated in the function block diagram of FIG. 4. In the following, these function blocks will be described with reference to FIG. 4.

First, in-cylinder intake air amount calculating means A1 obtains an in-cylinder intake air amount Mc(k), which is the amount of intake air newly drawn into the cylinder that is about to undergo an intake stroke in the present cycle. At this time, the in-cylinder intake air amount calculating means A1 determines the in-cylinder intake air amount Mc(k) based on the intake air flow rate Ga detected by the air-flow meter 61, the engine speed NE obtained from the output of the crank position sensor 64, and a table MapMc stored in the ROM 72. The suffix, "(k)" indicates the value for the intake stroke of the present cycle. Such suffixes will be attached to other physical quantities in this specification. The in-cylinder intake air amount Mc is recorded in the ROM 73 by being identified as corresponding to the intake stroke of each cylinder.

Upstream-side target air-fuel ratio setting means A2 determines an upstream-side target air-fuel ratio abyfr based on the engine speed NE and the throttle opening degree TA, which indicate the operation state of the internal combustion engine 10. After the internal combustion engine 10 has been warmed up, for example, the upstream-side target air-fuel ratio abyfr is set to the stoichiometric air-fuel ratio except in some specific circumstances.

Control target air-fuel ratio setting means A3 sets a control target air-fuel ratio abyfrs(k) based on the upstream-side target air-fuel ratio abyfr and a sub-feedback correction amount FBsub, which is calculated by sub-feedback correction amount calculating means A8 described later, as indicated by the following expression (1).

$$abyfrs(k)=abyfr\times(1-FBsub) \quad (1)$$

As shown from the above expression (1), the control target air-fuel ratio abyfrs(k) is set to an air-fuel ratio deviated from the upstream-side target air-fuel ratio abyfr by an amount corresponding to the sub-feedback correction amount FBsub. The control target air-fuel ratio abyfrs is recorded in the ROM 73 by being identified as corresponding to the intake stroke of each cylinder.

Base fuel injection amount calculating means A4 obtains a base fuel injection amount Fbase that corresponds to the in-cylinder intake air amount Mc(k) and is set so as to achieve the control target air-fuel ratio abyfrs(k). The base fuel injection amount Fbase is calculated by dividing the in-cylinder intake air amount Mc(k) by the control target air-fuel ratio abyfrs(k). As such, the control target air-fuel ratio abyfrs(k) is used to set the base fuel injection amount Fbase and also used in the main feedback control as will be described later.

Required fuel injection amount calculating means A5 obtains a required fuel injection amount Fi by adding a main feedback correction amount FBmain, which is calculated by main feedback correction amount calculating means A13 as will be described later, to the base fuel injection amount Fbase as in indicated by the following expression (2).

$$Fi=F\text{base}+FB\text{main} \quad (2)$$

The air-fuel ratio control system of the invention outputs an injection command of the required fuel injection amount Fi toward the injector 39 for the cylinder that is about to undergo an intake stroke in the present cycle. Thus, the main feedback control and the sub-feedback control are achieved as will be described later.

Hereinafter, the sub-feedback control will be described. Downstream-side target value setting means A6 determines a downstream-side target value Voxsref (i.e., reference value corresponding to the target air-fuel ratio) as the upstream-side target air-fuel ratio setting means A2 determines the upstream-side target air-fuel ratio abyfr, based on the operation state of the internal combustion engine 10 such as the engine speed NE and the throttle opening degree TA. After the internal combustion engine 10 has been warmed up, for example, the downstream-side target value Voxsref is set to 0.5 (V) corresponding to the stoichiometric air-fuel ratio except in some specific circumstances (Refer to FIG. 3). Further, in this example embodiment, the downstream-side target value Voxsref is set such that the air-fuel ratio corresponding to the downstream-side target value Voxsref is always equal to the upstream-side target air-fuel ratio abyfr.

Output deviation amount calculating means A7 obtains an output deviation amount DVoxs by subtracting the output value Voxs of the downstream-side air-fuel ratio sensor 67 presently obtained (more specifically, the output value Voxs obtained when a command for injecting fuel of the required fuel injection amount Fi at the present cycle starts to be issued) as indicated by the following expression (3). The output deviation amount DVoxs corresponds to the value corresponding to the deviation between the output value of the oxygen concentration sensor and a reference value corresponding to the target air-fuel ratio.

$$DVoxs=Voxsref-Voxs \quad (3)$$

Sub-feedback correction amount calculating means A8 (PID controller) obtains the sub-feedback correction amount FBsub by performing a proportional integral derivative processing (PID processing) to the output deviation amount DVoxs. Hereinafter, a description will be made, with reference to FIG. 5 indicating the function block diagram of the sub-feedback correction amount calculating means A8, of the method by which the sub-feedback correction amount calculating means A8 having function blocks A8*a* to A8*g* calculates the sub-feedback correction amount FBsub.

Proportional term calculating means A8*a* obtains a proportional term Ksubp (=Kp×DVoxs) of the sub-feedback correction amount FBsub by multiplying the output deviation amount DVoxs with a preset proportional gain Kp (proportional constant).

Integral processing means A8*b* calculates and updates an integral value of a deviation SDVoxs, which is a time integral value of the output deviation amount DVoxs, by sequentially integrating the output deviation amount DVoxs. The integral processing means A8*b* corresponds to "integral value calculating means".

Integral term calculating means A8*c* obtains an integral term Ksubi (=Ki×SDVoxs) of the sub-feedback correction amount FBsub by multiplying the integral value of the deviation SDVoxs with a preset integral gain Ki (integral constant).

Learning means A8*d* executes the learning process of the integral term Ksubi, which will be described later in detail, at predetermined time intervals. In the learning process for the integral term Ksubi, when a predetermined condition is satisfied, an update value DLearn for updating a learning value Learn (i.e., learning value of the integral term Ksubi) is determined, and the update value DLearn is added to the value of the learning value Learn presently recorded in the back-up RAM 74, whereby the learning value Learn is updated.

After updated by the learning process of the integral term Ksubi described above, the learning value Learn is then recorded in the back-up RAM 74. That is, the learning value Learn recorded in the RAM 74 varies in a stepped manner each time it is updated by the learning process of the integral term Ksubi described above. Meanwhile, each time the learning value Learn is updated, the integral value of the deviation SDVoxs (i.e., the value of the integral term Ksubi) is reset to zero.

Total sum calculating means A8*e* calculates a total sum SUM of the value of the integral term Ksubi and the learning value Learn (the value of the learning value Learn recorded in RAM 74). The total sum SUM practically serves as an integral term for the sub-feedback correction amount FBsub.

Derivative term calculating means A8*f* obtains a deferential term Ksubd (=Kd×DDVoxs) by multiplying a time derivative value DDVoxs of the output deviation amount DVoxs by a preset derivative gain Kd (derivative constant).

Summing means A8*g* obtains a sub-feedback correction amount FBsub, which is the value obtained by performing a proportional integral derivative processing (PID processing) to the output deviation amount DVoxs, by summing the proportional term Ksubp, the total sum SUM (i.e., practical integral term), and the derivative term Ksubd as indicated by the following expression (4) (where, $-1<FBsub<1$).

$$FBsub=Ksubp+SUM+Ksubd \quad (4)$$

Referring back to FIG. 4, as mentioned above, the sub-feedback correction amount FBsub is used to set the control target air-fuel ratio abyfrs(k). In addition, the control target air-fuel ratio abyfrs(k) set based on the sub-feedback correction amount FBsub is used in the main feedback control. Thus, the sub-feedback control is performed as will be described later.

Hereinafter, the main feedback control will be described. Table converting means A9 obtains the value of a detected air-fuel ratio abyfs(k) at the present cycle corresponding to the time the upstream-side air-fuel ratio sensor 66 makes a detection (more specifically, the time at which a fuel injection command of the required fuel injection amount Fi of the present cycle starts to be issued), based on the upstream-side air-fuel ratio sensor output value Vabyfs and the table shown in FIG. 2 which defines the relationship (i.e., solid line in FIG. 2) between the upstream-side air-fuel ratio sensor output value Vabyfs and the air-fuel ratio A/F. The detected air-fuel ratio abyfs is recorded in the RAM 73 by being identified as corresponding to the intake stroke of each cylinder.

Target air-fuel ratio delaying means A10 reads out, from among values of the control target air-fuel ratio abyfrs that have been obtained by the control target air-fuel ratio setting means A3 at each intake stroke and recorded in the ROM 73, the value of the control target air-fuel ratio abyfrs that was obtained N strokes (N times of intake strokes) before the present time, and the target air-fuel ratio delaying means A10 then sets the read value as a control target air-fuel ratio abyfrs (k−N). Here, "N" represents the number of strokes during the time period from a fuel injection command until the exhaust gas, due to combustion of fuel injected in response to the fuel injection command reaches the upstream-side air-fuel ratio sensor 66 (i.e., the detection portion of the upstream-side air-fuel ratio sensor 66). Hereinafter, this time period will be referred to as "delay time L". In the following, the delay time L and the stroke number N will be described in more detail.

In general, a command for injecting fuel is issued during each intake stroke (or before each intake stroke), and the injected fuel is ignited (combusted) in each combustion chamber 25 at a time point close to the compression stroke top dead center that comes after the intake stroke. As a result, the produced exhaust gas is discharged from the combustion chamber 25 to the exhaust passage via the surrounding of the corresponding exhaust valve 35. Then, the exhaust gas reaches the upstream-side air-fuel ratio sensor 66 (the detection portion of the upstream-side air-fuel ratio sensor 66) as the exhaust gas moves in the exhaust passage.

As such, the delay time L is expressed as the sum of strokes delay and transfer delay (i.e., the delay related to the movement of the exhaust gas in the exhaust passage). That is, detected air-fuel ratio abyfs from the upstream-side air-fuel ratio sensor 66 indicates the air-fuel ratio of the exhaust gas due to the fuel injection command which has been issued the delay time L before.

The strokes delay tends to decrease as the engine speed NE increases. Meanwhile, the transfer delay tends to decrease as the engine speed NE increases and as the in-cylinder intake air amount Mc increases. Thus, the stroke number N corresponding to the delay time L decreases as the engine speed NE increases and as the in-cylinder intake air amount Mc increases.

A low-pass filter A11 is a primary digital filter having a time constant $\tau$ that is equal to a time constant corresponding to the response delay of the upstream-side air-fuel ratio sensor 66. The control target air-fuel ratio abyfrs(k−N) is input to the low-pass filter A11 while the low-pass filter A11 outputs a low-pass-filter-processed control target air-fuel ratio abyfrslow that is a value obtained through the low-pass filtering of the control target air-fuel ratio abyfrs(k−N) using the time constant $\tau$.

Upstream-side air-fuel ratio deviation calculating means A12 obtains an upstream-side air-fuel ratio deviation DAF of N strokes before the present time, by subtracting the low-pass-filter-processed control target air-fuel ratio abyfrslow from the detected air-fuel ratio abyfs(k) of the present cycle, as indicated by the expression (5) shown below.

$$DAF=abyfs(k)-abyfrslow \quad (5)$$

The reason why the low-pass-filter-processed control target air-fuel ratio abyfrslow is subtracted from the detected air-fuel ratio abyfs(k) of the present cycle in order to determine the upstream-side air-fuel ratio deviation DAF of N strokes before the present time, is because, as mentioned above, the detected air-fuel ratio abyfs(k) of the present cycle indicates the air-fuel ratio of the exhaust gas which was produced from the injection command issued the delay time L before the present time (i.e., N strokes before the present time). The upstream-side air-fuel ratio deviation DAF is a value corresponding to the excess or deficiency of fuel supplied to the cylinder of N strokes before the present time.

Main feedback correction amount calculating means A13 (PI controller) obtains a main feedback correction amount FBmain for compensating for the excess or deficiency of the amount of fuel supplied of N strokes ago by performing a proportional integral processing (PI processing) to the upstream-side air-fuel ratio deviation DAF, as indicated by the expression (6) shown below. In the expression (6), "Gp" is a preset proportional gain (proportional constant), "Gi" is a preset integral gain (integral constant), and "SDAF" is an integral value (accumulated value) of the upstream-side air-fuel ratio deviation DAF.

$$FBmain=Gp\times DAF+Gi\times SDAF \quad (6)$$

The air-fuel ratio control system of the invention obtains the main feedback correction amount Fbmain, and then as mentioned above, the main feedback correction amount FBmain is added to the base fuel injection amount Fbase when the air-fuel ratio control system of the invention obtains the required fuel injection amount Fi. Thus, the main feedback control is performed as follows.

For example, when the catalyst upstream-side air-fuel ratio has varied toward the lean air-fuel ratio, the detected air-fuel ratio abyfs(k) becomes leaner (i.e., larger) than the low-pass-filter-processed control target air-fuel ratio abyfrslow, and therefore the upstream-side air-fuel ratio deviation DAF becomes a positive value. Consequently, the main feedback correction amount FBmain becomes a positive value. Thus, the required fuel injection amount Fi(k) becomes larger than the base fuel injection amount Fbase, and the air-fuel ratio is therefore controlled toward the rich air-fuel ratio. As a result, the detected air-fuel ratio abyfs(k) decreases, and the detected air-fuel ratio abyfs(k) is controlled to be equal to the low-pass-filter-processed control target air-fuel ratio abyfrslow.

On the contrary, when the catalyst upstream-side air-fuel ratio has varied toward the rich air-fuel ratio, the detected air-fuel ratio abyfs(k) becomes richer (i.e., smaller) than the low-pass-filter-processed control target air-fuel ratio abyfrslow, and therefore the upstream-side air-fuel ratio deviation DAF becomes a negative value. Consequently, the main feedback correction amount FBmain becomes a negative value. Thus, the required fuel injection amount Fi(k) becomes smaller than the base fuel injection amount Fbase, and the air-fuel ratio is therefore controlled toward the lean air-fuel ratio. As a result, the detected air-fuel ratio abyfs(k) increases, and the detected air-fuel ratio abyfs(k) is controlled to be equal to the low-pass-filter-processed control target air-fuel ratio abyfrslow. In this way, the main feedback control controls the required fuel injection amount Fi such that the detected air-fuel ratio abyfs(k) equals the low-pass-filter-processed control target air-fuel ratio abyfrslow.

The sub-feedback control is performed as a complement to (as a control for correcting) the main feedback control as follows. For example, when the air-fuel ratio of the exhaust gas downstream of the first catalyst 53 becomes lean, the output value Voxs of the downstream-side air-fuel ratio sensor 67 indicates the lean value. Then, the output deviation amount DVoxs becomes a positive value (Refer to FIG. 3), and therefore the sub-feedback correction amount FBsub becomes a positive value (Refer to FIG. 5). Thus, the control target air-fuel ratio abyfrs(k) (i.e., the low-pass-filter-processed control target air-fuel ratio abyfrslow) is set smaller than the upstream-side target air-fuel ratio abyfr (=the stoichiometric air-fuel ratio), that is, to a rich air-fuel ratio. As the main feedback control is performed in this state such that the detected air-fuel ratio abyfs(k) equals the low-pass-filter-processed control target air-fuel ratio abyfrslow, the required fuel injection amount Fi is increased, and the air-fuel ratio is controlled toward the rich air-fuel ratio. As a result, the output value Voxs of the downstream-side air-fuel ratio sensor 67 is controlled to be equal to the downstream-side target value Voxsref.

On the other hand, when the air-fuel ratio of the exhaust gas downstream of the first catalyst 53 becomes rich, the output value Voxs of the downstream-side air-fuel ratio sensor 67 indicates the rich air-fuel ratio. Then, the output deviation amount DVoxs becomes a negative value, and therefore the sub-feedback correction amount FBsub becomes a negative value. Thus, the control target air-fuel ratio abyfrs(k) (i.e., the low-pass-filter-processed control target air-fuel ratio abyfrslow) is set larger than the upstream-side target air-fuel ratio abyfr (=the stoichiometric air-fuel ratio), that is, to the lean air-fuel ratio. As the main feedback control is performed in this state such that the detected air-fuel ratio abyfs(k) equals the low-pass-filter-processed control target air-fuel ratio abyfrslow, the required fuel injection amount Fi is reduced, and the air-fuel ratio is controlled toward the lean air-fuel ratio. As a result, the output value Voxs of the downstream-side air-fuel ratio sensor 67 is controlled to be equal to the downstream-side target value Voxsref. As such, the required fuel injection amount Fi is controlled by the sub-feedback control such that the output value Voxs of the downstream-side air-fuel ratio sensor 67 equals the downstream-side target value Voxsref.

Further, because the main feedback correction amount FBmain includes the integral term, Gi×SDAF, it is ensured that the upstream-side air-fuel ratio deviation DAF becomes zero in the steady state. In other words, even when an error in the fuel injection amount, such as described above, is occurring as a result of the main feedback control, it is ensured that, in the steady state, the value of the integral term, Gi×SDAF, converges to the value corresponding to the magnitude of the error in the fuel injection amount, and the detected air-fuel ratio abyfs(k) converges to the low-pass-filter-processed control target air-fuel ratio abyfrslow. As such, the error in the fuel injection amount may be compensated for by the main feedback control.

Further, because the sub-feedback correction amount FBsub also includes an integral term (i.e., the total sum SUM that practically serves as an integral term), it is ensured that the output deviation amount DVoxs is zeroed in the steady state. In other words, even if an error in the upstream-side air-fuel ratio sensor 66 is occurring as a result of the sub-feedback control, it is ensured that, in the steady state, the total sum SUM converges to a value corresponding to the magnitude of the error in the upstream-side air-fuel ratio sensor 66 (which corresponds to "target convergence value"), and the output value Voxs of the downstream-side air-fuel ratio sensor 67 converges to the downstream-side target value Voxsref. As such, the error in the upstream-side air-fuel ratio sensor 66 may be compensated for by the sub-feedback control.

Meanwhile, because the base fuel injection amount calculating means A4 calculates the base fuel injection amount Fbase using the control target air-fuel ratio abyfrs instead of the target air-fuel ratio abyfr, and the target air-fuel ratio delaying means A10 and the low-pass filter A11 are provided, when the sub-feedback correction amount FBsub is deviating from a proper value for some reason, the main feedback correction amount FBmain may be prevented from deviating increasingly with time, whereby an increase in the deviation of the air-fuel ratio may be suppressed. This effect is described in detail in Japanese Patent Application No. 2005-338113.

Meanwhile, considering that both of the proportional term Ksubp and the derivative term Ksubd of the sub-feedback correction amount FBsub become zero in the steady state, the sub-feedback correction amount FBsub is equal to the total sum SUM (or the leaning value Learn). In the case where the total sum SUM (or the learning value Learn) is equal to the value corresponding to the magnitude of the error of the upstream-side air-fuel ratio sensor 66 (i.e., target convergence value) in the steady state, the control target air-fuel ratio abyfrs (=abyfr×(1−FBsub)=abyfr×(1−SUM)) equals the detected air-fuel ratio abyfs from the upstream-side air-fuel ratio sensor 66 that is obtained when the catalyst upstream-side air-fuel ratio is equal to the target air-fuel ratio abyfr (i.e., the stoichiometric air-fuel ratio AFth).

More specifically, the upstream-side air-fuel ratio sensor 66 has the output characteristic with respect to the air-fuel ratio as indicated by the broken line of FIG. 2 due to an error of the upstream-side air-fuel ratio sensor 66. In this case, the detected air-fuel ratio abyfs of the upstream-side air-fuel ratio sensor 66 (i.e., the air-fuel ratio which may be obtained from the solid line of FIG. 2 with respect to V1) becomes the value of AF1 when the catalyst upstream-side air-fuel ratio is equal to the upstream-side target air-fuel ratio abyfr, that is, to the stoichiometric air-fuel ratio AFth (Vabyfs=V1).

When the total sum SUM (or the learning value Learn) equals to the value corresponding to the magnitude of the error of the upstream-side air-fuel ratio sensor 66 (i.e., target convergence value) in the steady state, the control target air-fuel ratio abyfrs (=abyfr×(1−SUM)) equals the value of AF1. As the main feedback control is performed in this state such that the detected air-fuel ratio abyfs equals the control target air-fuel ratio abyfrs (i.e., the low-pass-filter-processed control target air-fuel ratio abyfrslow), the catalyst upstream-side air-fuel ratio is controlled to be equal to the target air-fuel ratio abyfr (=the stoichiometric air-fuel ratio AFth). In this case, the target convergence value L1 for the total sum SUM (or the learning value Learn), which corresponds to the magnitude of the error of the upstream-side air-fuel ratio sensor 66, is equal to 1−AF1/abyfr (>0).

In other words, if the total sum SUM (or the learning value Learn) is equal to the target convergence value L1 corresponding to the magnitude of the error of the upstream-side air-fuel ratio sensor 66, it indicates that the actual air-fuel ratio which the air-fuel ratio control system of the invention treats as an air-fuel ratio equal to the target air-fuel ratio abyfr (i.e., the stoichiometric air-fuel ratio AFth) (will be referred to as "control center air-fuel ratio AFcen") is actually equal to the target air-fuel ratio abyfr (i.e., the stoichiometric air-fuel ratio AFth). As such, when the control center air-fuel ratio AFcen is equal to the target air-fuel ratio abyfr (i.e., the stoichiometric air-fuel ratio AFth), the error of the upstream-side air-fuel ratio sensor 66 may be properly compensated for and the air-fuel ratio of the exhaust gas downstream of the first catalyst 53 may be properly controlled to be equal to the target air-fuel ratio abyfr (i.e., the stoichiometric air-fuel ratio AFth).

Figure 5:
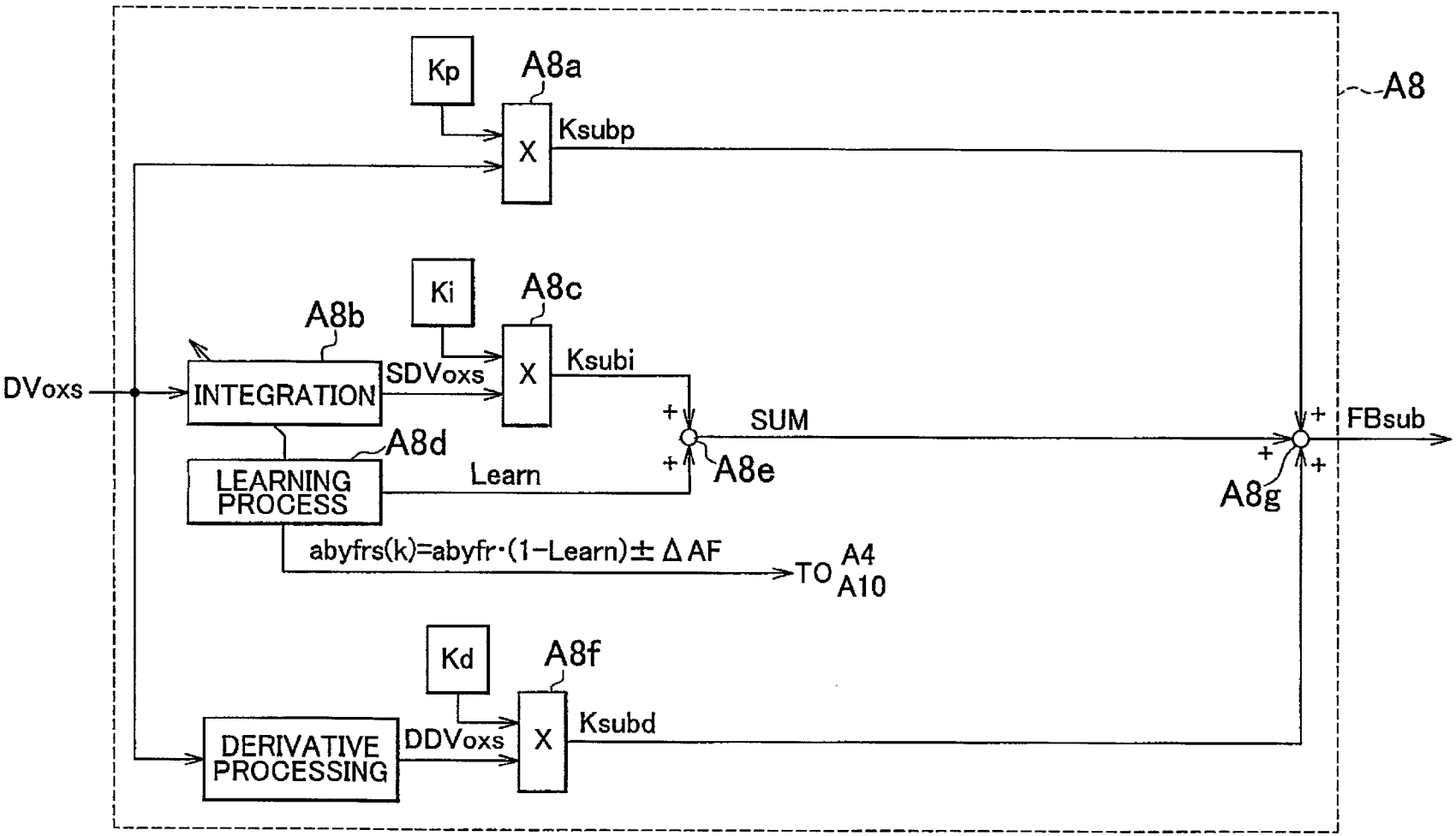
FIG. 5 is a function block diagram illustrating function blocks used when the sub-feedback correction amount calculating means calculates the sub-feedback correction amount.

Next, a description will be made of the learning process of the integral term Ksubi (i.e., updating of the learning value Learn of the integral term Ksubi) by the learning means A8*d* (Refer to FIG. 5). If the learning value Learn of the integral term Ksubi is deviating from the target convergence value L1 corresponding to the magnitude of the error of the upstream-side air-fuel ratio sensor 66, the control center air-fuel ratio AFcen becomes a value deviating from the target air-fuel ratio abyfr (i.e., the stoichiometric air-fuel ratio AFth). In this case, there is a possibility that the error of the upstream-side air-fuel ratio sensor 66 is not properly compensated for and the catalyst upstream-side air-fuel ratio and the air-fuel ratio of the exhaust gas downstream of the first catalyst 53 is not properly controlled to be equal to the target air-fuel ratio abyfr (i.e., the stoichiometric air-fuel ratio AFth).

Therefore, in the case where the control center air-fuel ratio AFcen is deviating from the target air-fuel ratio abyfr (i.e., the stoichiometric air-fuel ratio AFth), it is necessary to update the learning value Learn so as to bring it closer to the target convergence value L1 corresponding to the magnitude of the error of the upstream-side air-fuel ratio sensor 66. Hereinafter, the outline of the method by which the air-fuel ratio control system of the invention (the learning means A8*d*) updates the learning value Learn will be described with reference to FIG. 6 to FIG. 8. In the following description, it is assumed that an error of the upstream-side air-fuel ratio sensor 66 is occurring and therefore the output characteristic of the upstream-side air-fuel ratio sensor 66 is similar to the broken line in FIG. 2, as in the case described above.

Figure 6:
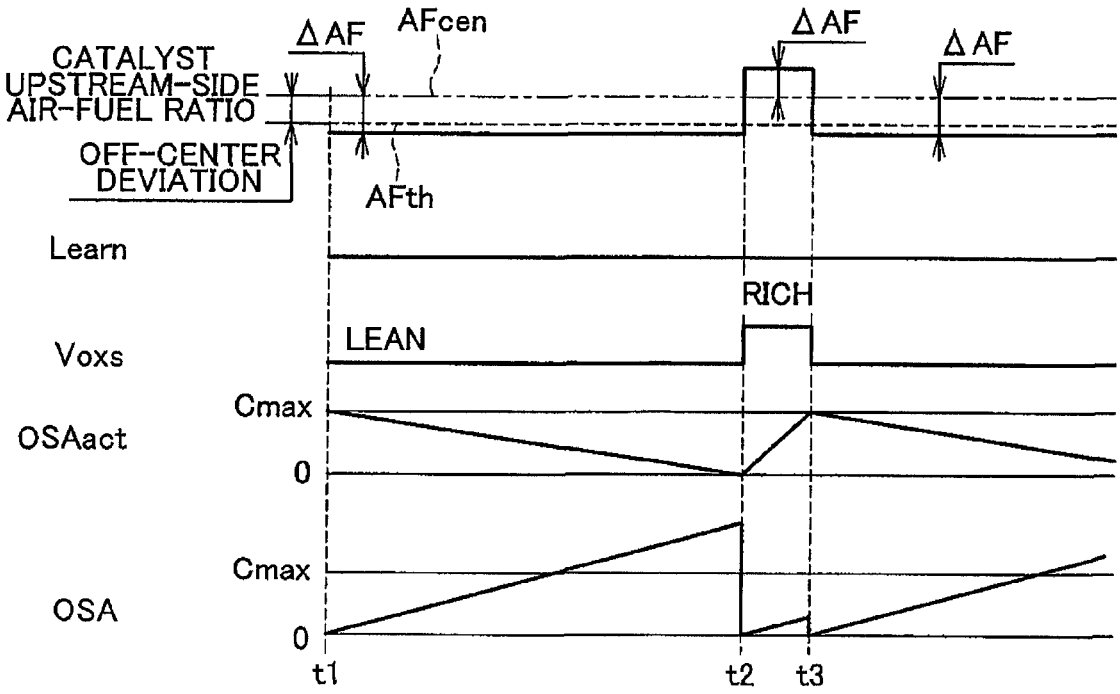
FIG. 6 is a timing chart illustrating an example case where the active air-fuel ratio control is executed when the control center air-fuel ratio is deviating from the stoichiometric air-fuel ratio.

FIG. 6 illustrates a state where the control center air-fuel ratio AFcen is deviating from the target air-fuel ratio abyfr (i.e., the stoichiometric air-fuel ratio AFth) toward the lean air-fuel ratio (Refer to "OFF-CENTER DEVIATION" in FIG. 6). That is, the learning value Learn is maintained at a value smaller than the target convergence value L1, and "abyfr×(1−Learn)" is larger than "AF1" (Refer to FIG. 2) by the amount of the off-center deviation. Here, the control center air-fuel ratio AFcen may be said to be the catalyst upstream-side air-fuel ratio corresponding to the state where the detected air-fuel ratio abyfs is equal to "abyfr×(1−Learn)".

FIG. 6 illustrates a control in which the control target air-fuel ratio abyfrs is set to abyfr×(1−Learn)−ΔAF when the downstream-side air-fuel ratio sensor output value Voxs has been inverted from the rich value to the lean value (time t1, t3) while the control target air-fuel ratio abyfrs is set to abyfr×(1−Learn)+ΔAF when the downstream-side air-fuel ratio sensor output value Voxs has been inverted from the lean value to the rich value (time t2). This control will hereinafter be referred to as "active air-fuel ratio control".

While the control target air-fuel ratio abyfrs is set to abyfr×(1−Learn)−ΔAF (from time t1 to t2, and after t3) under the active air-fuel ratio control, the detected air-fuel ratio abyfs is controlled to be equal to abyfr×(1−Learn)−ΔAF (rich air-fuel ratio control), whereby the catalyst upstream-side air-fuel ratio is controlled to AFcen−ΔAF and the catalyst upstream-side air-fuel ratio is (can be) controlled to an air-fuel ratio that is richer than the stoichiometric air-fuel ratio AFth. As such, an actual oxygen storage amount OSAact, which is the amount of oxygen stored in the first catalyst 53, gradually decreases from a maximum oxygen storage amount Cmax. Then, the downstream-side air-fuel ratio sensor output value Voxs is inverted from the lean value to the rich value in response to the actual oxygen storage amount OSAact reaching zero (time t2). In response to this, the control target air-fuel ratio abyfrs is switched to abyfr×(1−Learn)+ΔAF.

On the other hand, while the control target air-fuel ratio abyfrs is set to abyfr×(1−Learn)+ΔAF (from time t2 to t3) under the active air-fuel ratio control, the detected air-fuel ratio abyfs is controlled to be equal to abyfr×(1−Learn)+ΔAF (lean air-fuel ratio control), whereby the catalyst upstream-side air-fuel ratio is controlled to AFcen+ΔAF and the catalyst upstream-side air-fuel ratio is (can be) controlled to an air-fuel ratio that is leaner than the stoichiometric air-fuel ratio AFth. As such, the actual oxygen storage amount OSAact gradually increases from zero, and the downstream-side air-fuel ratio sensor output value Voxs is inverted from the rich value to the lean value in response to the actual oxygen storage amount OSAact reaching the maximum oxygen storage capacity Cmax (time t3). In response to this, the control target air-fuel ratio abyfrs is switched to abyfr×(1−Learn)−ΔAF. As such, during the active air-fuel ratio control, the control target air-fuel ratio abyfrs (i.e., the catalyst upstream-side air-fuel ratio) is alternately inverted between rich and lean.

When the control center air-fuel ratio AFcen is equal to the stoichiometric air-fuel ratio AFth (i.e., when the learning value Learn is equal to the target convergence value L1) during the active air-fuel ratio control, the catalyst upstream-side air-fuel ratio may be made equal to AFth+ΔAF (corresponding to "target lean air-fuel ratio") during the lean air-fuel ratio control mode and to AFth−ΔAF (corresponding to "target rich air-fuel ratio") during the rich air-fuel ratio control mode.

In this case, the amount of deviation of the catalyst upstream-side air-fuel ratio from the stoichiometric air-fuel ratio AFth becomes ΔAF both during the rich air-fuel ratio control mode and during the lean air-fuel ratio control mode. On the other hand, the rate of change in the actual oxygen storage amount OSAact (the rate of increase and decrease in the actual oxygen storage amount OSAact) is proportional to the amount of deviation of the catalyst upstream-side air-fuel ratio from the stoichiometric air-fuel ratio AFth. As such, when the control center air-fuel ratio AFcen is equal to the stoichiometric air-fuel ratio AFth, the duration of the rich air-fuel ratio control mode and the duration of the lean air-fuel ratio control mode are equal (or substantially equal) to each other.

Meanwhile, as shown in FIG. 6, when the control center air-fuel ratio AFcen is leaner than the stoichiometric air-fuel ratio AFth (i.e., when the learning value Learn is smaller than the target convergence value L1), the catalyst upstream-side air-fuel ratio, during the lean air-fuel ratio control mode, becomes leaner than AFth+ΔAF by the aforementioned off-center deviation, and the catalyst upstream-side air-fuel ratio, during the rich air-fuel ratio control mode, becomes richer than AFth−ΔAF by the aforementioned off-center deviation. In other words, the amount of deviation of the catalyst upstream-side air-fuel ratio from the stoichiometric air-fuel ratio AFth becomes larger during the lean air-fuel ratio control mode, and becomes smaller during the rich air-fuel ratio control mode.

Thus, during the lean air-fuel ratio control mode, the rate of increase in the actual oxygen storage amount OSAact becomes higher, whereby the duration of the lean air-fuel ratio control mode (from t2 to t3) decreases. On the other hand, during the rich air-fuel ratio control mode, the rate of decrease in the actual oxygen storage amount OSAact becomes lower, whereby the duration of the rich air-fuel ratio control mode (from t1 to t2) increases.

Hereinafter, consideration will be made as to an accumulated value OSA that represents the accumulated variation of the oxygen storage amount in the first catalyst 53. (Refer to FIG. 6) The accumulated value OSA is accumulated from zero and added up each time the downstream-side air-fuel ratio sensor output value Voxs is inverted between rich and lean as indicated by the expression (7) shown below. In the expression (7), "0.23" is the mass ratio of oxygen in air and "0.23×Fi×ΔAF" represents the excess or deficiency of oxygen in the exhaust gas entering the first catalyst 53 per injection of fuel. That is, the calculation of the accumulated value OSA assumes that the catalyst upstream-side air-fuel ratio is constantly controlled to AFth−ΔAF during the rich air-fuel ratio control mode, and constantly controlled to AFth+ΔAF during the lean air-fuel ratio control mode. In other words, it is assumed that the control center air-fuel ratio AFcen is equal to the stoichiometric air-fuel ratio AFth.

$$OSA=\Sigma(0.23\times Fi\times\Delta AF) \quad (7)$$

Thus, the rate of change in the accumulated value OSA (the rate of increase in the OSA) is constant as long as the required fuel injection amount Fi and the engine speed NE remain constant, irrespective of the amount of deviation of the control center air-fuel ratio AFcen from the stoichiometric air-fuel ratio AFth and irrespective of whether the lean air-fuel ratio control mode or the rich air-fuel ratio control mode is presently performed. When the control center air-fuel ratio AFcen is equal to the stoichiometric air-fuel ratio AFth, the time that the accumulated value OSA reaches the maximum oxygen storage capacity Cmax may coincide with the time that the downstream-side air-fuel ratio sensor output value Voxs is inverted.

On the other hand, as shown in FIG. 6, when the control center air-fuel ratio AFcen is deviating from the stoichiometric air-fuel ratio AFth toward the lean air-fuel ratio, the duration of the rich air-fuel ratio control mode increases (Refer to t1 to t2). Therefore, the downstream-side air-fuel ratio sensor output value Voxs is not inverted from the lean value to the rich value even when the accumulated value OSA reaches the maximum oxygen storage capacity Cmax during the rich air-fuel ratio control mode.

That is, if the downstream-side air-fuel ratio sensor output value Voxs is not inverted from the lean value to the rich value even when the accumulated value OSA reaches the maximum oxygen storage capacity Cmax during the rich air-fuel ratio control mode, it may be determined that the control center air-fuel ratio AFcen is deviating from the stoichiometric air-fuel ratio AFth toward the lean air-fuel ratio.

Figure 7:
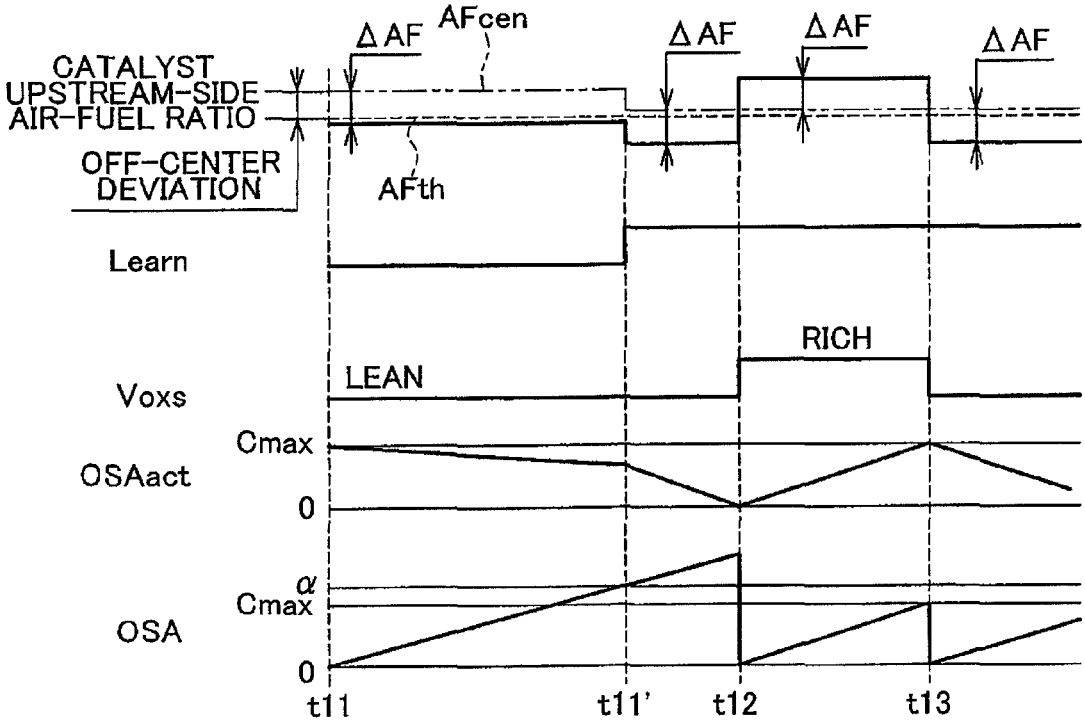
FIG. 7 is a timing chart corresponding to the timing chart of FIG. 6 and illustrating another example case where the learning value of the integral value of the deviation is updated when the next inversion of the output value of the downstream-side air-fuel ratio sensor does not take place within a predetermined time after the output value of the downstream-side air-fuel ratio sensor has been inverted during the active air-fuel ratio control.

Thus, as shown in FIG. 7 corresponding to FIG. 6 (t11, t12, t13 of FIG. 7 correspond to t1, t2, t3 of the FIG. 6), the air-fuel ratio control system of the invention updates the learning value Learn to a larger value (i.e., a value that makes the air-fuel ratio of the exhaust gas entering the catalyst richer) if the downstream-side air-fuel ratio sensor output value Voxs is not inverted from the lean value to the rich value even when the accumulated value OSA reaches α that is slightly larger than the maximum oxygen storage capacity Cmax (time t11') during the rich air-fuel ratio control mode under the active air-fuel ratio control (from t11 to t12, and after t13). As a result, after t11', the learning value Learn that has been smaller than the target convergence value L1 approaches the target convergence value L1, and the control center air-fuel ratio AFcen approaches the stoichiometric air-fuel ratio AFth.

Likewise, if the downstream-side air-fuel ratio sensor output value Voxs is not inverted from the rich value to the lean value even when the accumulated value OSA reaches the maximum oxygen storage capacity Cmax during the lean air-fuel ratio control mode under the active air-fuel ratio control, it may be determined that the control center air-fuel ratio AFcen is deviating from the stoichiometric air-fuel ratio AFth toward the rich air-fuel ratio. To cope with this, the air-fuel ratio control system of the invention updates the learning value Learn to a smaller value (i.e., a value that makes the air-fuel ratio of the exhaust gas entering the catalyst leaner) if the downstream-side air-fuel ratio sensor output value Voxs is not inverted from the rich value to the lean value even when the accumulated value OSA reaches α during the lean air-fuel ratio control mode. As a result, the learning value Learn that has been larger than the target convergence value L1 approaches the target convergence value L1, and the control center air-fuel ratio AFcen approaches the stoichiometric air-fuel ratio AFth.

On the other hand, as shown in FIG. 6, when the control center air-fuel ratio AFcen is deviating from the stoichiometric air-fuel ratio AFth toward the lean air-fuel ratio, the duration of the lean air-fuel ratio control mode decreases (Refer to t2 to t3). Therefore, the downstream-side air-fuel ratio sensor output value Voxs is inverted from the rich value to the lean value before the accumulated value OSA reaches the maximum oxygen storage capacity Cmax during the lean air-fuel ratio control mode (Refer to t3).

That is, if the downstream-side air-fuel ratio sensor output value Voxs has been inverted from the rich value to the lean value before the accumulated value OSA reaches the maximum oxygen storage capacity Cmax during the lean air-fuel ratio control mode, it may be determined that the control center air-fuel ratio AFcen is deviating from the stoichiometric air-fuel ratio AFth toward the lean air-fuel ratio.

Figure 8:
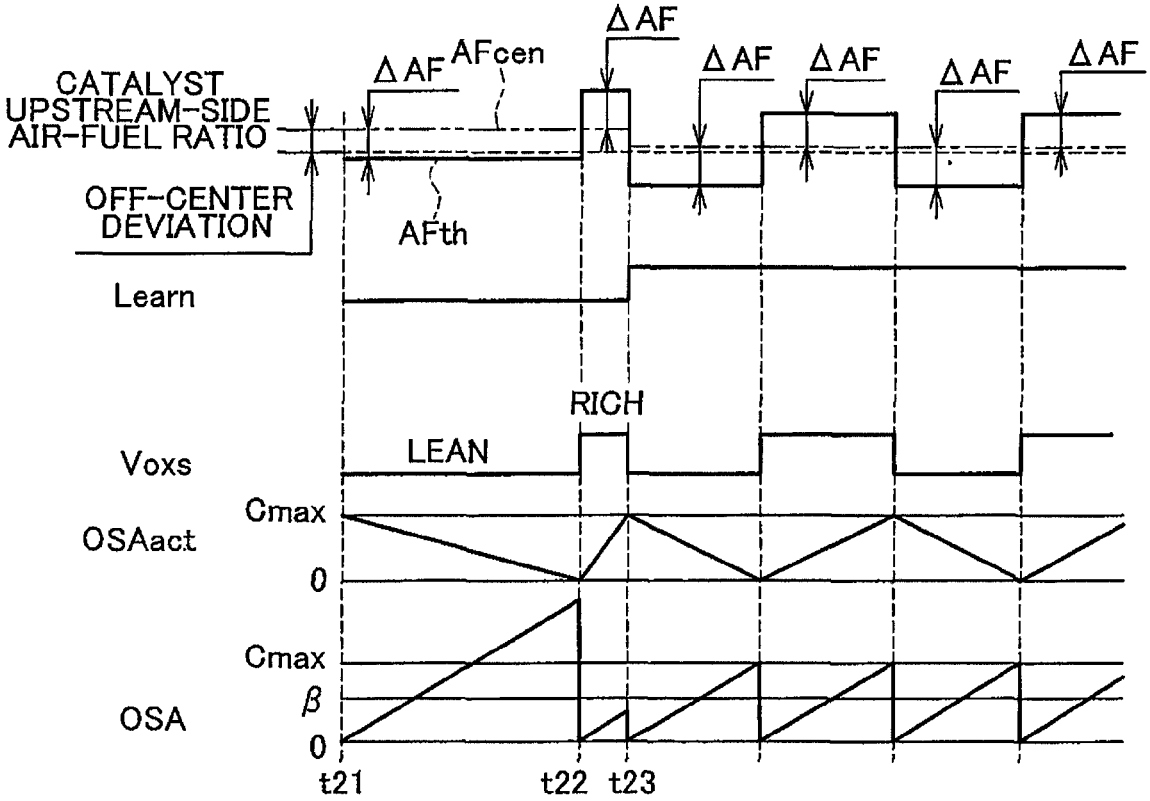
FIG. 8 is a timing chart corresponding to the timing chart of FIG. 6 and illustrating still another example case where the learning value of the integral value of the deviation is updated when the next inversion of the output value of the downstream-side air-fuel ratio sensor has taken place within a predetermined time after the output value of the downstream-side air-fuel ratio sensor was inverted during the active air-fuel ratio control.

Thus, as shown in FIG. 8 corresponding to FIG. 6 (t21, t22, t23 of FIG. 8 correspond to t1, t2, t3 of the FIG. 6), the air-fuel ratio control system of the invention updates the learning value Learn to a larger value (i.e., a value that makes the air-fuel ratio of the exhaust gas entering the catalyst richer) when the downstream-side air-fuel ratio sensor output value Voxs has been inverted from the rich value to the lean value before the accumulated value OSA reaches β that is slightly smaller than the maximum oxygen storage capacity Cmax (time t23) during the lean air-fuel ratio control mode (from t22 to t23). As a result of this, after t23, the learning value Learn that has been smaller than the target convergence value L1 approaches the target convergence value L1, so that the control center air-fuel ratio AFcen approaches the stoichiometric air-fuel ratio AFth.

Likewise, when the downstream-side air-fuel ratio sensor output value Voxs has been inverted from the lean value to the rich value before the accumulated value OSA reaches the maximum oxygen storage capacity Cmax during the rich air-fuel ratio control mode, it may be determined that the control center air-fuel ratio AFcen is deviating from the stoichiometric air-fuel ratio AFth toward the rich air-fuel ratio. To cope with this, the air-fuel ratio control system of the invention updates the learning value Learn to a smaller value (i.e., a value that makes the air-fuel ratio of the exhaust gas entering the catalyst leaner) when the downstream-side air-fuel ratio sensor output value Voxs has been inverted from the lean value to the rich value before the accumulated value OSA reaches β during the rich air-fuel ratio control mode. As a result, the learning value Learn that has been larger than the target convergence value L1 approaches the target convergence value L1, and the control center air-fuel ratio AFcen approaches the stoichiometric air-fuel ratio AFth. This is the outline of the learning process of the integral term Ksubi, that is, the updating of the learning value Learn for the integral term Ksubi according to the air-fuel ratio control system of the invention.

Next, the actual operation of the air-fuel ratio control system according to the invention will be described with reference to the flowcharts of FIG. 9 to FIG. 13 and the timing chart of FIG. 14. FIG. 14, like FIG. 6, illustrates a state where the control center air-fuel ratio AFcen is deviating from the stoichiometric air-fuel ratio AFth toward the lean air-fuel ratio (Refer to "OFF-CENTER DEVIATION" in FIG. 14). That is, FIG. 14 illustrates a state where the learning value Learn is set to a value smaller than the target convergence value L1 corresponding to the magnitude of the error of the upstream-side air-fuel ratio sensor 66. Note that, in the following description, "Map X(a1, a2 . . . )" represents a table for obtaining the value of X that uses a1, a2 . . . as arguments. Further, in the case where the values of the arguments are the values detected by the corresponding sensors, the present values are used.

Figure 9:
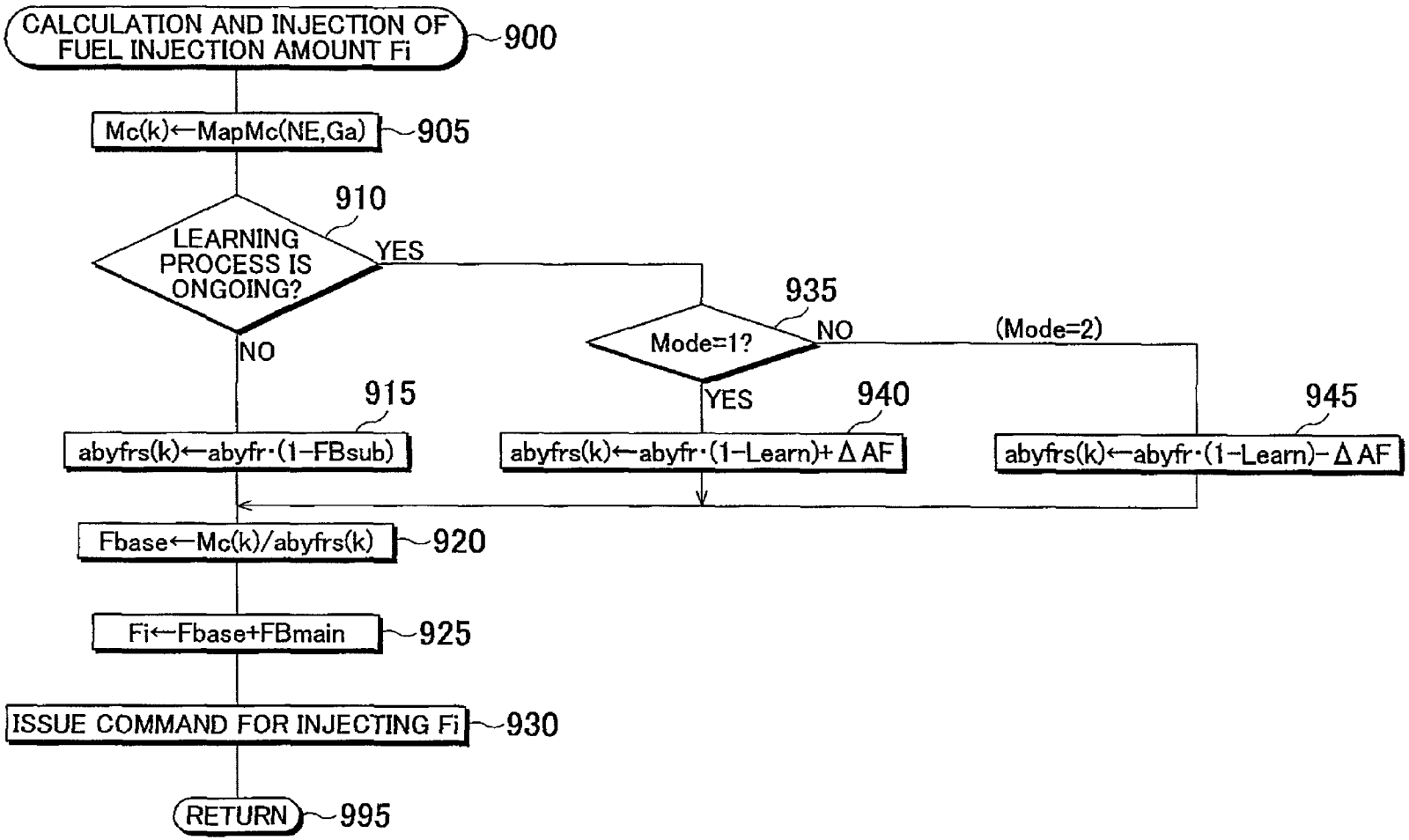
FIG. 9 is a flowchart illustrating a routine that the CPU shown in FIG. 1 executes to calculate the required fuel injection amount and issue a corresponding fuel injection command.

The CPU 71 repeatedly executes the routine illustrated by the flowchart of FIG. 9 each time the crank angle of each cylinder reaches a predetermined crank angle before top dead center of the intake stroke (e.g., BTDC 90° CA). This routine is executed to calculate the required fuel injection amount Fi and issue fuel injection commands.

When the crank angle of the cylinder that is about to undergo an intake stroke in the present cycle (will be referred to as "fuel injection cylinder" where necessary) reaches the predetermined crank angle, the CPU 71 starts the routine from step 900 and then proceeds to step 905. In step 905, the CPU 71 estimates, using the table MapMc (NE, Ga), the in-cylinder intake air amount Mc(k) that is the amount of intake air newly drawn into the fuel injection cylinder.

Then, the CPU 71 proceeds to step 910 and determines whether the learning process is ongoing. The learning process is executed, for example, under the condition that the internal combustion engine 10 operates in the steady state; a predetermined time has passed since the end of the last learning process; and the downstream-side air-fuel ratio sensor output value Voxs is indicating the rich value. The learning process is finished, for example, when a predetermined time has passed since the learning value Learn was newly updated.

If the learning process is not presently ongoing, the CPU 71 determines "NO" in step 910 and then proceeds to step 915. In step 915, the CPU 71 obtains the control target air-fuel ratio abyfrs(k) based on the target air-fuel ratio abyfr (=the stoichiometric air-fuel ratio AFth), the latest value of the sub-feedback correction amount FBsub obtained by the routine described later (at the time of the last fuel injection), and the foregoing expression (1). Then, in step 920, the CPU 71 obtains the base fuel injection amount Fbase by dividing the in-cylinder intake air amount Mc(k) by the control target air-fuel ratio abyfrs(k).

Next, the CPU 71 proceeds to step 925. In step 925, the CPU 71 calculates the required fuel injection amount Fi by adding the latest value of the main feedback correction amount FBmain obtained by the routine described later (at the time of the last fuel injection) to the base fuel injection amount Fbase.

Next, the CPU 71 proceeds to step 930. In step 930, the CPU 71 issues a fuel injection command of the required fuel injection amount Fi. Then, the CPU 71 proceeds to 995 and finishes the present cycle of the routine. In this way, the main feedback control and the sub-feedback control are performed. The control during the learning process will be described later.

Figure 10:
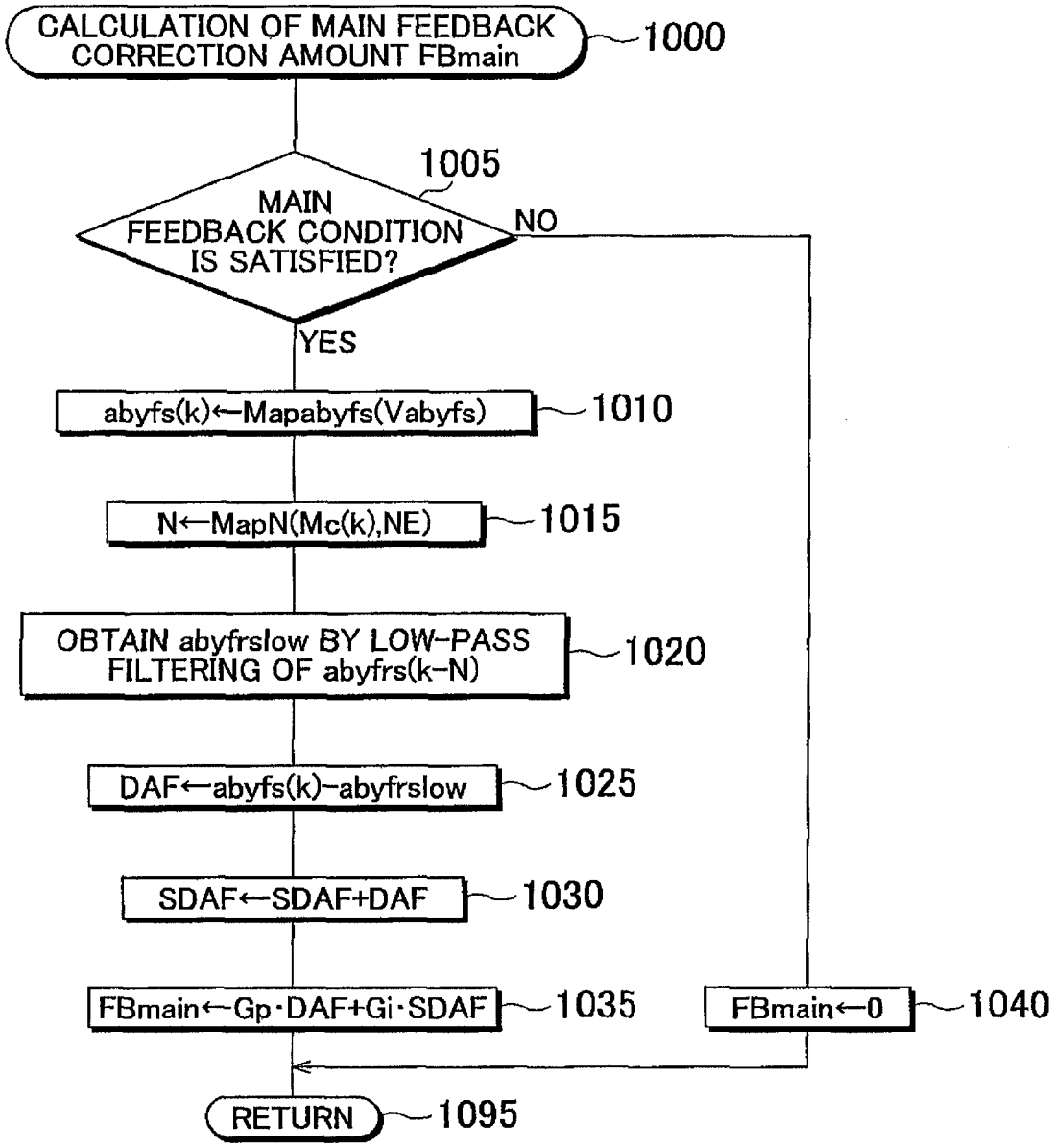
FIG. 10 is a flowchart illustrating a routine that the CPU shown in FIG. 1 executes to calculate the main feedback correction amount.

When the CPU 71 calculates the main feedback correction amount FBmain in the main feedback control, the CPU 71 repeatedly executes the routine illustrated by the flowchart of FIG. 10 each time the fuel injection start time (injection command issuing time) for the fuel injection cylinder becomes.

Therefore, when the fuel injection start time becomes, the CPU 71 starts the routine from step 1000 and then proceeds to step 1005. In step 1005, the CPU 71 determines whether a main feedback condition is satisfied. The main feedback condition is regarded as being satisfied, for example, when the coolant temperature THW of the engine is equal to or higher than a first reference temperature; when the upstream-side air-fuel ratio sensor 66 is in a normal state (including an activated state); and when the in-cylinder intake air amount Mc is equal to or smaller than a predetermined amount.

If the main feedback condition is presently satisfied, the CPU 71 determines "YES" in step 1005 and then proceeds to step 1010. In step 1010, the CPU 71 obtains the detected air-fuel ratio abyfs(k) of the present cycle, based on the table Mapabyfs (Vabyfs) (Refer to the solid line in FIG. 2).

Next, the CPU 71 proceeds to step 1015 and determines the stroke number N based on the table MapN(Mc(k), NE). Then, the CPU 71 proceeds to step 1020 and obtains the low-pass-filter-processed control target air-fuel ratio abyfrslow by performing a low-pass filtering to abyfrs (k-N), which is the control target air-fuel ratio before N strokes CN times of intake strokes) from the present time, using the time constant τ.

Then, the CPU 71 proceeds to step 1025 and calculates the upstream-side air-fuel ratio deviation DAF by subtracting the low-pass-filter-processed control target air-fuel ratio abyfrslow from the detected air-fuel ratio abyfs(k), as indicated by the foregoing expression (5).

Then, the CPU 71 proceeds to step 1030 and updates the integral value SDAF of the upstream-side air-fuel ratio deviation DAF by adding the upstream-side air-fuel ratio deviation DAF obtained in step 1025 to the integral value SDAF of the step 1030. Then, the CPU 71 proceeds to step 1035 and obtains the main feedback correction amount FBmain as indicated by the foregoing expression (6). Then, the CPU 71 proceeds to step 1095 and finishes the present cycle of the routine.

As such, the main feedback correction amount FBmain is obtained, and the main feedback control is performed by applying the calculated main feedback correction amount FBmain to the required fuel injection amount Fi in step 925 in FIG. 9.

On the other hand, if the main feedback condition is not satisfied at the time of executing step 1005, the CPU 71 determines "NO" in step 1005 and then proceeds to step 1040. In step 1040, the CPU 71 sets the main feedback correction amount FBmain to zero. Then, the CPU 71 proceeds to step 1095 and finishes the present cycle of the routine. As such, when the main feedback condition is not satisfied, the main feedback correction amount FBmain is set to zero and therefore the air-fuel ratio feedback control based on the main feedback control is not performed.

Figure 11:
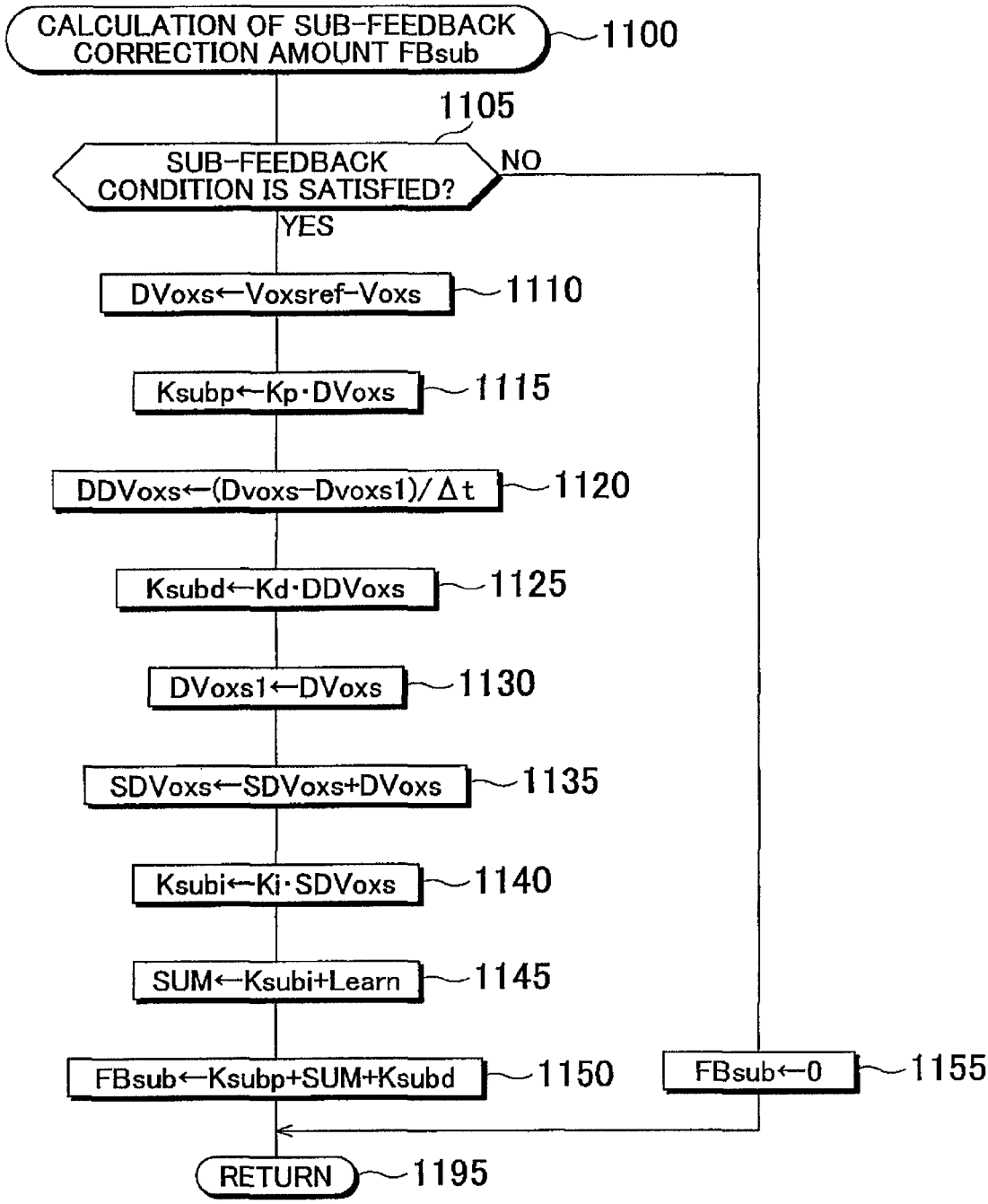
FIG. 11 is a flowchart illustrating a routine that the CPU shown in FIG. 1 executes to calculate the sub-feedback correction amount.

When the CPU 71 calculates the sub-feedback correction amount FBsub during the sub-feedback control, the CPU 71 repeatedly executes the routine illustrated by the flowchart of the FIG. 11 each time the fuel injection start time (fuel injection command issuing time) for the fuel injection cylinder becomes.

Therefore, when the fuel injection start time for the fuel injection cylinder becomes, the CPU 71 starts the routine from step 1100 and proceeds to step 1105. In step 1105, the CPU 71 determines whether a sub-feedback condition is presently satisfied. The sub-feedback conditioned is regarded as being satisfied when the coolant temperature THW of the engine is equal to or higher than a second reference temperature, which is higher than the first reference value, in addition to the foregoing main feedback condition.

If the sub-feedback condition is presently satisfied, the CPU 71 determines "YES" in step 1105 and then proceeds to step 1110. In step 1110, the CPU 71 calculates the output deviation amount DVoxs by subtracting the downstream-side air-fuel ratio sensor output value Voxs at the present time from the downstream-side target value Voxsref, as indicated by the foregoing expression (3). Then, in step 1115, the CPU 71 calculates the proportional term Ksubp by multiplying the output deviation amount DVoxs by the proportional gain Kp.

Then, the CPU 71 proceeds to step 1120 and calculates the derivative value DDVoxs of the output deviation amount Dvoxs, as indicated by the expression (8) shown below. In the expression (8), "Dvoxs1" represents the last cycle value of the output deviation amount DVox that was updated in step 1130 in the last cycle of the routine (the process in step 1130 will be described later), and "Δt" represents the time from the execution of the last cycle of the routine to the execution of the present cycle of the routine.

$$DDVox=(DVoxs-DVoxs1)/\Delta t \quad (8)$$

Then, the CPU 71 proceeds to step 1125 and calculates the derivative term Ksubd by multiplying the time derivative value DDVoxs of the output deviation amount Dvoxs by the derivative gain Kd. Then, in step 1130, the CPU 71 sets the last cycle value DVoxs1 of the output deviation amount DVoxs to the value of the output deviation amount DVoxs calculated in step 1110 of the present cycle.

Then, the CPU 71 proceeds to step 1135 and updates the integral value of the deviation SDVoxs by adding the output deviation amount DVoxs obtained in step 1110 to the integral value of the deviation SDVoxs of the step 1135. Then, in step 1140, the CPU 71 calculates the integral term Ksubi by multiplying the integral value of the deviation SDVoxs by the integral gain Ki. Then, in step 1145, the CPU 71 calculates the total sum SUM by summing the integral term Ksubi and the learning value Learn of the integral term Ksubi, which is set and updated in the routine described later.

Then, the CPU 71 proceeds to step 1150 and calculates the sub-feedback correction amount FBsub using the proportional term Ksubp calculated in step 1115, the derivative term Ksubd calculated in step 1125, the total sum SUM obtained in step 1145, and the foregoing expression (4). Then, the CPU 71 proceeds to step 1195 and finishes the present cycle of the routine.

As such, the sub-feedback correction amount FBsub is obtained. Then, the sub-feedback correction amount FBsub is applied to the control target air-fuel ratio abyfrs(k) in step 915 of FIG. 9. This control target air-fuel ratio abyfrs(k) is then used in the routine shown in FIG. 10 (i.e., the main feedback control). This is how the sub-feedback control is performed.

On the other hand, if it is determined in step 1105 that the sub-feedback control is not satisfied, the CPU 71 determines "NO" in step 1105 and then proceeds to step 1155. In step 1155, the CPU 71 sets the value of the sub-feedback correction amount FBsub to zero. Then, the CPU 71 proceeds to step 1195 and finishes the present cycle of the routine. As such, when the sub-feedback condition is not satisfied, the sub-feedback correction amount FBsub is set to zero and therefore the air-fuel ratio feedback control based on the sub-feedback control is not performed.

Figure 12:
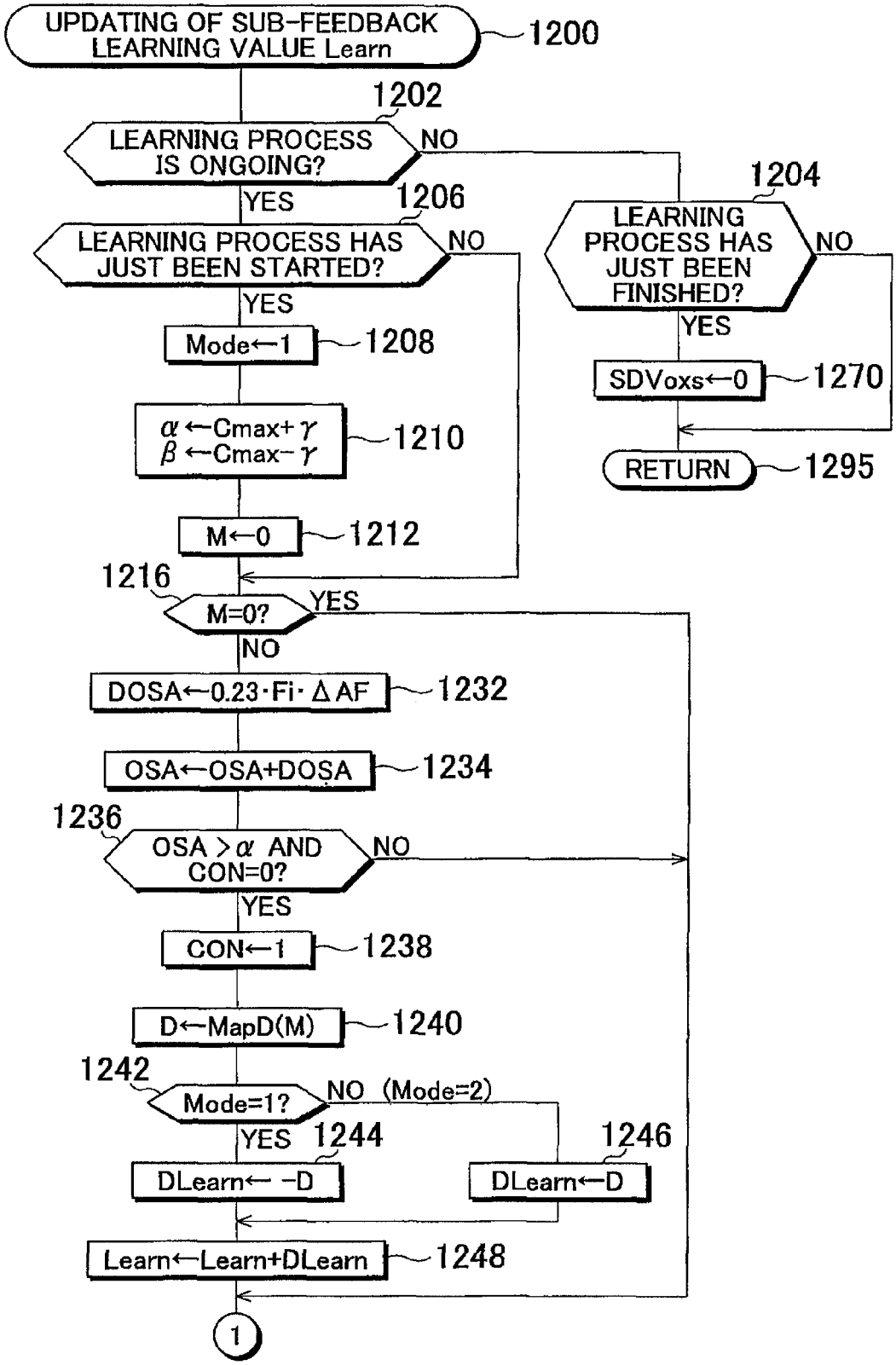
FIG. 12 is a flowchart illustrating the former half of a routine that the CPU shown in FIG. 1 executes to update the learning value
Figure 13:
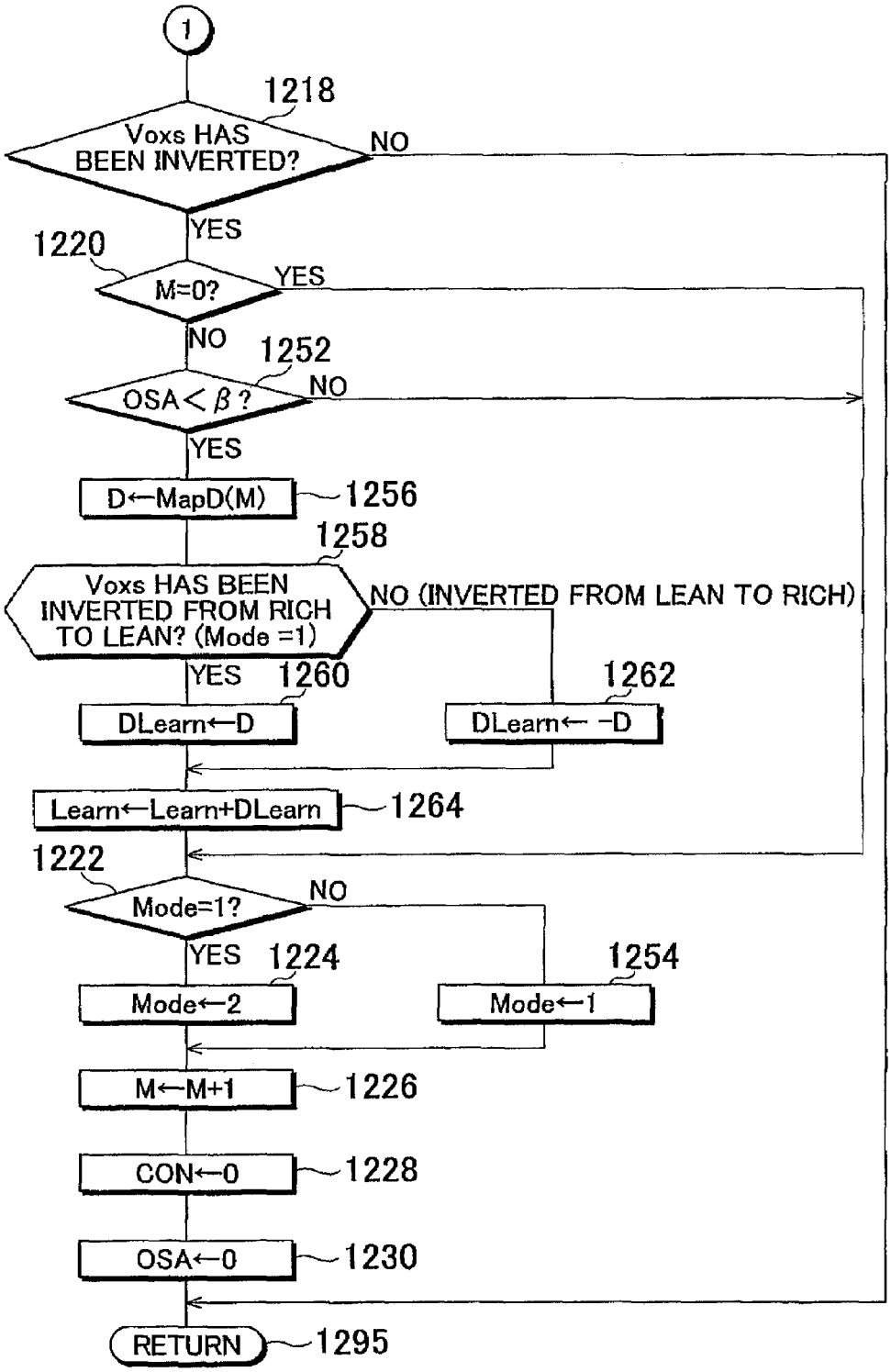
FIG. 13 is a flowchart illustrating the latter half of the routine that the CPU shown in FIG. 1 executes to update the learning value.
Figure 14:
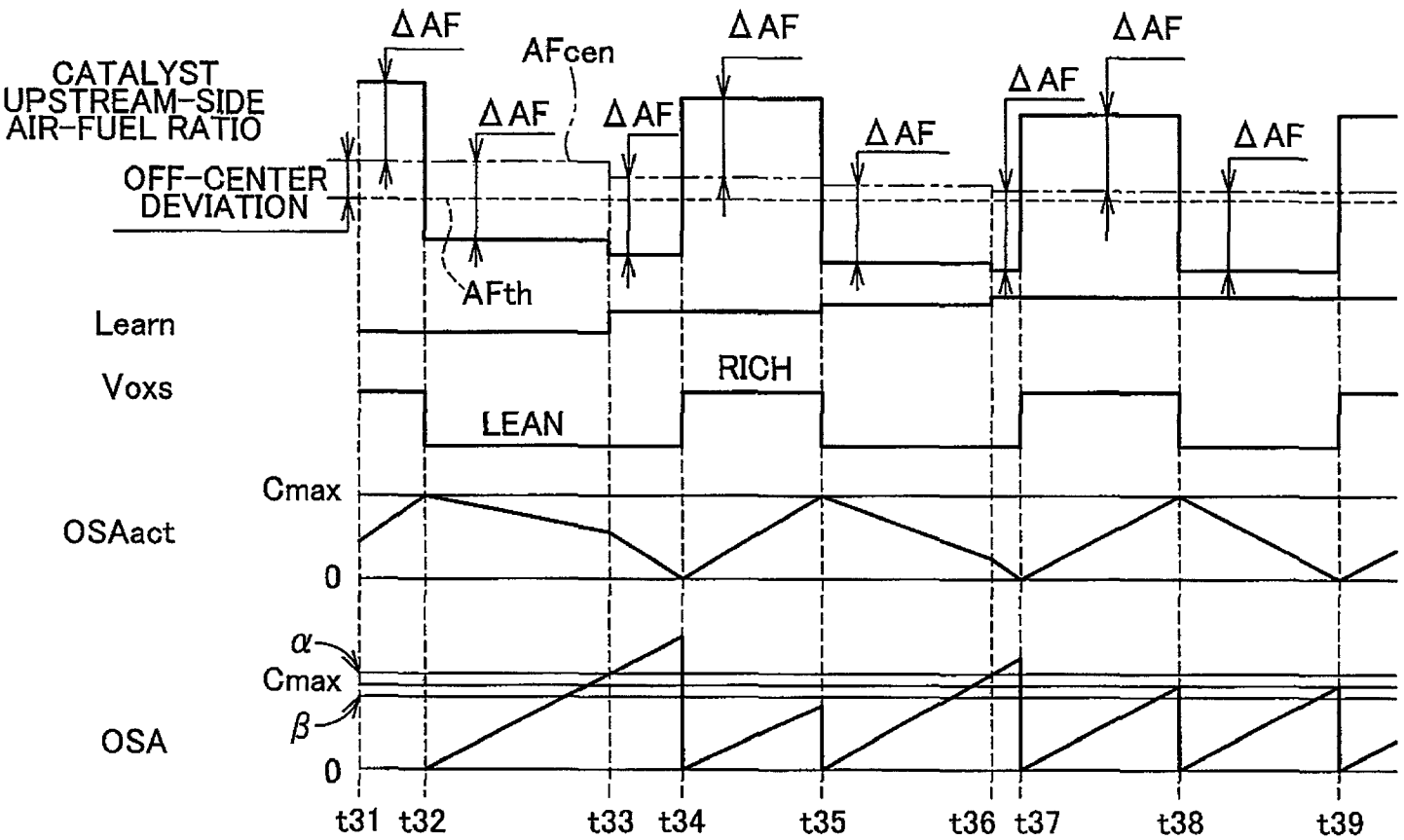
FIG. 14 is a timing chart illustrating an example case where the learning value of the integral value of the deviation is updated by the air-fuel ratio control system shown in FIG. 1.

When the CPU 71 updates the learning value Learn of the integral term Ksubi, the CPU 71 repeatedly executes the routine illustrated by the flowcharts of FIG. 12 and FIG. 13 each time the fuel injection start time (injection command issuing time) for the fuel injection cylinder becomes.

Therefore, when the fuel injection start time becomes, the CPU 71 starts the routine from step 1200 and proceeds to step 1202. In step 1202, the CPU 71 determines whether the learning process is presently ongoing. If not (i.e., "NO" in step 1202), the CPU 71 then proceeds to step 1204 and determines whether the learning process has just been finished. If not (i.e., "NO" in step 1204), the CPU 71 then proceeds to step 1295 and finishes the present cycle of the routine.

If the learning process just started at time t31 in FIG. 14, the CPU 71 determines "YES" in step 1202 and then proceeds to step 1206. In step 1206, the CPU 71 determines whether the learning process has just started. Because the present time (t31) is immediately after the start of the learning process, the CPU 71 determines "YES" in step 1206 and then proceeds to step 1208. In step 1208, the CPU 71 sets Mode to 1. If Mode is 1, it indicates that the lean air-fuel ratio control mode of the active air-fuel ratio control is being executed. On the other hand, if Mode is 2, it indicates that the rich air-fuel ratio control mode of the active air-fuel ratio control is being executed.

Then, the CPU 71 proceeds to step 1210 and sets α to a value obtained by adding a constant γ (>0) to the maximum oxygen storage capacity Cmax, and sets β to a value obtained by subtracting the constant γ (>0) from the maximum oxygen storage capacity Cmax. The maximum oxygen storage capacity $C_{max}$, for example, may be obtained and updated at given time intervals using a method known in the art.

Then, the CPU 71 proceeds to step 1212 and resets an inversion number M to zero. The inversion number M represents the number of times the downstream-side air-fuel ratio sensor output value Voxs has been inverted between rich and lean since the beginning of the learning process.

Then, the CPU 71 proceeds to step 1216 and determines whether the inversion number M is zero. At this time, the CPU 71 determines "YES" in step 1216 and proceeds to step 1218 in FIG. 13. In step 1218, the CPU 71 determines whether the downstream-side air-fuel ratio sensor output value Voxs has been inverted. Because the downstream-side air-fuel ratio sensor output value Voxs has not yet been inverted at the time immediately after t31, the CPU 71 determines "NO" in step 1218. Then, the CPU 71 proceeds to step 1295 and finishes the present cycle of the routine. After this, the CPU 71 repeats the processes in steps 1202, 1206, 1216, 1218 and 1295 until the downstream-side air-fuel ratio sensor output value Voxs is inverted.

The learning process is performed and Mode is 1 after t31. Therefore, the CPU 71, while repeating the routine of FIG. 9, determines "YES" in step 910 after t31 and then proceeds to step 935. In step 935, the CPU 71 determines whether Mode is 1. At this time, the CPU 71 determines "YES" in step 935, and proceeds to step 940.

In step 940, the CPU 71 sets the control target air-fuel ratio abyfrs(k) to abyfr×(1−Learn)+ΔAF. Thus, this control target air-fuel ratio abyfrs(k) is used in the routine of FIG. 10, whereby the lean air-fuel ratio control mode of the active air-fuel ratio control (the control mode that adjusts the catalyst upstream-side air-fuel ratio to AFcen+ΔAF) is executed. This lean air-fuel ratio control mode is continued until the downstream-side air-fuel ratio sensor output value Voxs is inverted from the rich value to the lean value (Refer to t31 to t32). During this, the actual oxygen storage amount OSAact increases.

Next, a description will be made of a case where, in the above state, the actual oxygen storage amount OSAact reaches the maximum oxygen storage capacity Cmax and then the downstream-side air-fuel ratio sensor output value Voxs has been inverted from the rich value to the lean value (Refer to t32). In this case, the CPU 71, while repeating the routines of FIG. 12 and FIG. 13, determines "YES" in step 1218 and then proceeds to step 1220. In step 1220, the CPU 71 determines whether the inversion number M is zero. At this time, the CPU 71 determines "YES" in step 1220 and then proceeds to step 1222. In step 1222, the CPU 71 determines whether Mode is 1.

At this time, because Mode is 1, the CPU 71 determines "YES" in step 1222 and then proceeds to step 1224 and sets Mode to 2. Then, the CPU 71 proceeds to step 1226 and increments the inversion number M by 1. Then, in step 1228, the CPU 71 sets a flag CON to zero. Then, in step 1230, the CPU 71 resets the accumulated value OSA to zero. Note that the flag CON will be later described.

As such, Mode is 2 after t32. Therefore, while repeating the routine of FIG. 9, the CPU 71 determines "NO" in step 935 and then proceeds to step 945. In step 945, the CPU 71 sets the control target air-fuel ratio abyfrs(k) to abyfr×(1−Learn)−ΔAF. This control target air-fuel ratio abyfrs(k) is then used in the routine of FIG. 10, whereby the rich air-fuel ratio control mode of the active air-fuel ratio control (the control mode that adjusts the catalyst upstream-side air-fuel ratio to AFcen−ΔAF) is executed. This rich air-fuel ratio control is continued until the downstream-side air-fuel ratio sensor output value Voxs is inverted from the lean value to the rich value (Refer to t32 to t34). During this, the actual oxygen storage amount OSAact decreases from the maximum oxygen storage capacity Cmax.

After t32, the inversion number M is not zero. Therefore, while repeating the routines of FIG. 12 and FIG. 13, the CPU 71 determines "NO" in step 1216 after t32 and then proceeds to step 1232. In step 1232, the CPU 71 calculates, as indicated by the expression shown in the box of step 1232 in FIG. 12, DOSA corresponding to the variation of the oxygen storage amount per fuel injection. Then, in step 1234, the CPU 71 accumulates and updates the accumulated value OSA by adding DOSA to the present value of the accumulated value OSA. Note that the calculation of the accumulated value OSA by steps 1232, 1234 corresponds to the calculation of the accumulated value OSA using the foregoing expression (7).

Then, the CPU 71 proceeds to step 1236 and determines whether the accumulated value OSA is larger than α and the flag CON is zero. Immediately after t32, the accumulated value OSA is smaller than α although the flag CON is zero. Therefore, the CPU 71 determines "NO" in step 1236 and then proceeds to step 1218.

That is, the CPU 71 monitors, after t32 (i.e., after M≠0 becomes true), whether the accumulated value OSA, which increases from zero as step 1234 is repeated, has exceeded α (step 1236) or whether the downstream-side air-fuel ratio sensor output value Voxs has been inverted (step 1218).

Next, a description will be made of a case where, in the above state, the accumulated value OSA has exceeded α before the downstream-side air-fuel ratio sensor output value Voxs is inverted (Refer to t33). In this case, the CPU 71 determines "YES" in step 1236 and then proceeds to step 1238. In step 1238, the CPU 71 sets the flag CON to 1.

Figure 15:
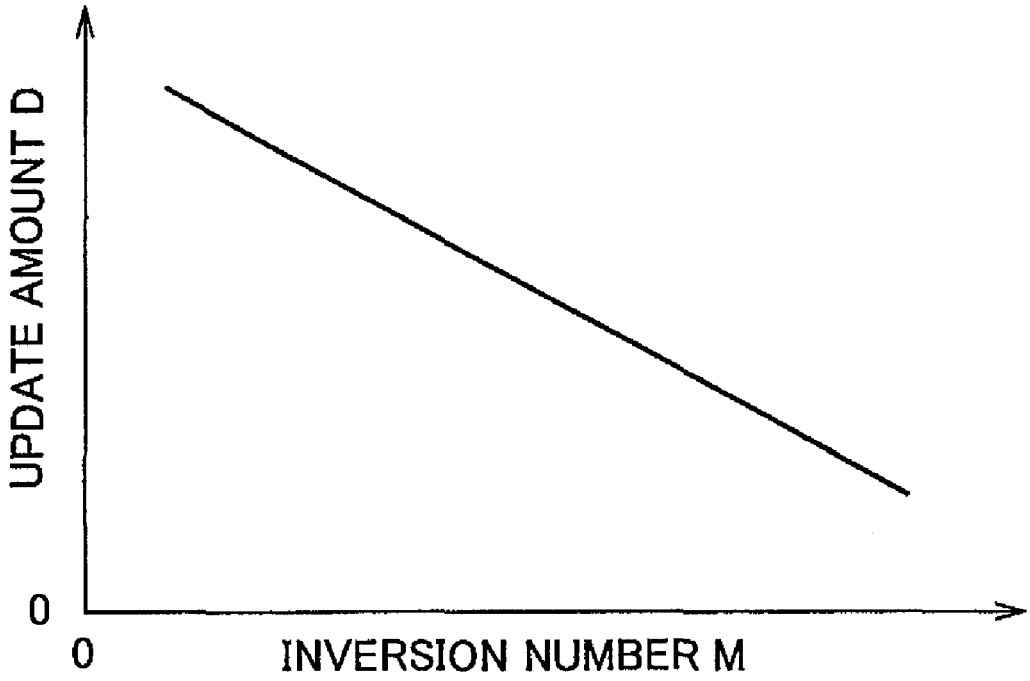
FIG. 15 is a graph illustrating the relation between the number of times of inversion of the output value of the downstream-side air-fuel ratio sensor and the update amount of the learning value, which is referenced by the CPU shown in FIG. 1.

Then, the CPU 71 proceeds to step 1240 and obtains an update amount D (>0) for the learning value Learn, based on a table MapD(M) illustrated by the graph of FIG. 15. The update amount D for the learning value Learn is determined smaller as the inversion number M increases.

Then, the CPU 71 proceeds to step 1242 and determines whether Mode is 1. If Mode is 1 in step 1242, the CPU 71 then proceeds to step 1244 and sets an update value Dlearn for the learning value Learn to "−D". If value Mode is not 1 in step 1242, conversely, the CPU 71 then proceeds to 1246 and sets the update value Dlearn to "D". As such, when the accumulated value OSA exceeds α during the lean air-fuel ratio control mode, the update value Dlearn is set to −D, and when the accumulated value OSA exceeds α during the rich air-fuel ratio control mode, the update value Dlearn is set to D. Because Mode is 2 at t33 (i.e., during the rich air-fuel ratio control mode), the update value Dlearn is set to D.

Then, the CPU 71 proceeds to step 1248 and updates the learning value Learn by adding the update value DLearn to the present value of the learning value Learn. As such, at t33, the learning value Learn is increased by the update amount D in a stepped manner. As a result, the control center air-fuel ratio AFcen shifts toward the rich air-fuel ratio and thus approaches the stoichiometric air-fuel ratio AFth, whereby the catalyst upstream-side air-fuel ratio (i.e., AFcen−ΔAF) shifts toward the rich air-fuel ratio. Note that, in the example illustrated in FIG. 14, the learning value Learn is not sufficiently close to the target convergence value L1 even after t33, and therefore the control center air-fuel ratio AFcen is largely deviating from the stoichiometric air-fuel ratio AFth toward the lean air-fuel ratio.

After this, the accumulated value OSA is larger than α and the flag CON is 1. Therefore, the CPU 71 determines "NO" in step 1236, whereby the learning value Learn is prevented from being updated in step 1248 repeatedly, and consecutively, during the lean or rich air-fuel ratio control mode.

As such, after t33, the CPU 71 determines "No" in step 1216 and proceeds to step 1218. In step 1218, the CPU 71 monitors whether the downstream-side air-fuel ratio sensor output value Voxs has been inverted from the lean value to the rich value.

Hereinafter, a description will be made of a case where, in the above state, the actual oxygen storage amount OSAact reaches zero and the downstream-side air-fuel ratio sensor output value Voxs has been inverted from the lean value to the rich value (Refer to t34). In this case, while repeating the routines of FIG. 12 and FIG. 13, the CPU 71 determines "YES" in step 1218 and then proceeds to step 1220. At this time, the CPU 71 determines "NO" in step 1220 and then proceeds to step 1252. In step 1252, the CPU 71 determines whether the accumulated value OSA is smaller than β.

Because the accumulated value OSA is presently larger than α, the CPU 71 determines "NO" in step 1252 and then proceeds to step 1222. At this time, the CPU 71 determines "NO" in step 1222 and then proceeds to step 1254. In step 1254, the CPU 71 sets Mode to 1. Then, the CPU 71 executes the processes of steps 1226, 1228, and 1230, in sequence.

As such, Mode is 1 after t34. Therefore, while repeating the routine of FIG. 9, the CPU 71 determines "YES" in step 935 after t34, whereby the lean air-fuel ratio control mode (the control mode that adjusts the catalyst upstream-side air-fuel ratio to AFcen+ΔAF) is restarted. During this lean air-fuel ratio control mode (Refer to t34 to t35), the actual oxygen storage amount OSAact increases from zero.

Further, the inversion number M is not 0 after t34. Therefore, while repeating the routines of FIG. 12 and FIG. 13, the CPU 71, after t34, monitors whether the accumulated value OSA, which increases from zero as step 1234 is repeated as mentioned above, has exceeded α (step 1236) or whether the downstream-side air-fuel ratio sensor output value Voxs has been inverted (step 1218).

Next, a description will be made of a case where, in the above state, the downstream-side air-fuel ratio sensor output value Voxs has been inverted from the rich value to the lean value before the accumulated value OSA reaches β (Refer to t35). In this case, the CPU 71 determines "YES" in step 1218 and then proceeds to step 1220. In step 1220, the CPU 71 determines "NO" and then proceeds to step 1252. At this time, the CPU 71 determines "YES" in step 1252 and then proceeds to step 1256.

In step 1256, the CPU 71 determines the update amount D by processing similarly to the above-described step 1240. Note that, at this time, the update amount D is made smaller than the update amount D that was determined at t33 (Refer to FIG. 15).

Then, the CPU 71 proceeds to step 1258 and determines whether the downstream-side air-fuel ratio sensor output value Voxs has been inverted from the rich value to the lean value. If the CPU 71 determines "YES" in step 1258, the CPU 71 then proceeds to step 1260 and sets the update value Dlearn for the learning value Learn to D. If the CPU 71 determines "NO" in step 1258, conversely, the CPU 71 then proceeds to step 1262 and sets the update value Dlearn to −D. As such, when the downstream-side air-fuel ratio sensor output value Voxs has been inverted from the rich value to the lean value before the accumulated value OSA reaches β during the lean air-fuel ratio control mode, the update value Dlearn is set to D. On the other hand, when the downstream-side air-fuel ratio sensor output value Voxs has been inverted from the lean value to the rich value before the accumulated value OSA reaches β during the rich air-fuel ratio control mode, the update value Dlearn is set to −D. At t35, the update value Dlearn is set to D.

Then, the CPU 71 proceeds to step 1264 and updates the learning value Learn by adding the update value Dlearn to the present value of the learning value Learn as in step 1248. Thus, at t35, the learning value Learn is increased by the update amount D in a stepped manner. As a result, the control center air-fuel ratio AFcen shifts again toward the rich air-fuel ratio and thus approaches the stoichiometric air-fuel ratio AFth, whereby the catalyst upstream-side air-fuel ratio (i.e., AFcen—ΔAF) shifts toward the rich air-fuel ratio during the rich air-fuel ratio control mode that is subsequently started. Note that, in the example illustrated in FIG. 14, the learning value Learn is not sufficiently close to the target convergence value L1 even after t35, and therefore the control center air-fuel ratio AFcen is largely deviating from the stoichiometric air-fuel ratio AFth toward the lean air-fuel ratio.

Then, the CPU 71 proceeds to step 1222 and determines "YES". Then, the CPU 71 proceeds to step 1224 and sets Mode to 2. Then, the CPU 71 executes the processes of steps 1226, 1228, and 1230, in sequence.

As such, Mode is 2 after t35. Therefore, the rich air-fuel ratio control mode (the control mode that adjusts the catalyst upstream-side air-fuel ratio to AFcen−ΔAF) is restarted after t35. During this rich air-fuel ratio control (Refer to t35 to t37), the actual oxygen storage amount OSAact decreases from the maximum oxygen storage capacity Cmax.

Further, the inversion number M is not zero after t35. Therefore, while repeating the routines of FIG. 12 and FIG. 13, the CPU 71, after t35, monitors whether the accumulated value OSA has exceeded α (step 1236) or whether the downstream-side air-fuel ratio sensor output value Voxs has been inverted (step 1218).

If, in the above state, the accumulated value OSA has exceeded α before the downstream-side air-fuel ratio sensor output value Voxs is inverted as shown at t36, the update amount D is newly determined, and the learning value Learn is increased by the newly determined update amount D in a stepped manner as it is at t33. As a result, the control center air-fuel ratio AFcen shifts toward the rich air-fuel ratio and thus approaches the stoichiometric air-fuel ratio AFth, whereby the catalyst upstream-side air-fuel ratio (i.e., AFcen−ΔAF) shifts toward the rich air-fuel ratio during the rich air-fuel ratio control mode.

In the example illustrated in FIG. 14, after t36, the learning value Learn is sufficiently close to the target convergence value L1 and therefore the control center air-fuel ratio AFcen is sufficiently close to the stoichiometric air-fuel ratio AFth. Therefore, after t36, the CPU 71 does not determine "YES" in step 1236 or in step 1252, and therefore the learning value Learn is not updated. That is, the learning value Learn is maintained at the value updated at t36.

Then, when the learning process has been finished due to, for example, the elapse of a predetermined time from when the learning value Learn was updated the last time, the CPU 71, while repeating the routines of the FIG. 12 and FIG. 13, determines "NO" in step 1202 and then proceeds to step 1204.

At this time, because the learning process has just been finished, the CPU 71 determines "YES" in step 1204 and then proceeds to step 1270. In step 1270, the CPU 71 resets the integral value of the deviation SDVoxs to zero. As such, the integral value of the deviation SDVoxs is reset to zero each time the learning process is finished. Further, when the learning process has been finished, the CPU 71, while repeating the routine of FIG. 9, determines "NO" in step 910 and then executes the process of step 915 again, whereby the active air-fuel ratio control is finished.

Meanwhile, because step 1216 and step 1220 are provided, the updating of the learning value Learn is not performed when the inversion number M is 0 (t31 to t32 in FIG. 14). That is, because it is not guaranteed that the actual oxygen storage amount OSAact is zero at the time of starting the learning process (i.e., the time of starting the lean air-fuel ratio control mode, that is, t31 in FIG. 14), whether to update the learning value Learn should not be determined based on the comparison between the accumulated value OSA and α in step 1236 or based on the comparison between the accumulated value OSA and β in step 1252.

As described above, the air-fuel ratio control system of the example embodiment of the invention executes the active air-fuel ratio control that, in order to determine whether to update the learning value Learn for the integral term Ksubi in the sub-feedback control executed using the output value Voxs of the downstream-side air-fuel ratio sensor 67, sets the control target air-fuel ratio abyfrs to abyfr×(1−Learn)−ΔAF when the downstream-side air-fuel ratio sensor output value Voxs has been inverted from the rich value to the lean value (the rich air-fuel ratio control mode) and sets the control target air-fuel ratio abyfrs to abyfr×(1−Learn)+ΔAF when the downstream-side air-fuel ratio sensor output value Voxs has been inverted from the lean value to the rich value (the lean air-fuel ratio control mode).

That is, if the downstream-side air-fuel ratio sensor output value Voxs is not inverted from the lean value to the rich value even after the accumulated value OSA reaches α (=Cmax+γ) during the rich air-fuel ratio control mode of the active air-fuel ratio control, it may be determined that the control center air-fuel ratio AFcen is deviating from the stoichiometric air-fuel ratio AFth toward the lean air-fuel ratio. Therefore, the learning value Learn is updated to a larger value (i.e., a value that makes the air-fuel ratio of the exhaust gas entering the catalyst richer). As a result of this, the learning value Learn that has been smaller than the target convergence value L1 of the learning value Learn corresponding to the magnitude of the error of the upstream-side air-fuel ratio sensor 66, approaches the target convergence value L1, whereby the control center air-fuel ratio AFcen approaches the stoichiometric air-fuel ratio AFth. On the other hand, if the downstream-side air-fuel ratio sensor output value Voxs is not inverted from the lean value to the rich value even after the accumulated value OSA reaches α (=Cmax+γ) during the lean air-fuel ratio control mode of the active air-fuel ratio control, it may be determined that the control center air-fuel ratio AFcen is deviating from the stoichiometric air-fuel ratio AFth toward the rich air-fuel ratio. Therefore, the learning value Learn is updated to a smaller value (i.e., a value that makes the air-fuel ratio of the exhaust gas entering the catalyst leaner). As a result of this, the learning value Learn that has been larger than the target convergence value L1 of the learning value Learn corresponding to the magnitude of the error of the upstream-side air-fuel ratio sensor 66, approaches the target convergence value L1, whereby the control center air-fuel ratio AFcen approaches the stoichiometric air-fuel ratio AFth.

Likewise, if the downstream-side air-fuel ratio sensor output value Voxs has been inverted from the rich value to the lean value before the accumulated value OSA reaches β (=Cmax−γ) during the lean air-fuel ratio control mode of the active air-fuel ratio control, it may be determined that the control center air-fuel ratio AFcen is deviating from the stoichiometric air-fuel ratio AFth toward the lean air-fuel ratio. Therefore, the learning value Learn is updated to a larger value (i.e., a value that makes the air-fuel ratio of the exhaust gas entering the catalyst richer). As a result of this, the learning value Learn that has been smaller than the target convergence value L1 of the learning value Learn, approaches the target convergence value L1, whereby the control center air-fuel ratio AFcen approaches the stoichiometric air-fuel ratio AFth. On the other hand, if the downstream-side air-fuel ratio sensor output value Voxs has been inverted from the lean value to the rich value before the accumulated value OSA reaches β (=Cmax−γ) during the rich air-fuel ratio control mode of the active air-fuel ratio control, it may be determined that the control center air-fuel ratio AFcen is deviating from the stoichiometric air-fuel ratio AFth toward the rich air-fuel ratio. Therefore, the learning value Learn is updated to a smaller value (i.e., a value that makes the air-fuel ratio of the exhaust gas entering the catalyst leaner). As a result of this, the learning value Learn that has been larger than the target convergence value L1 of the learning value Learn, approaches the target convergence value L1, whereby the control center air-fuel ratio AFcen approaches the stoichiometric air-fuel ratio AFth.

Accordingly, even when the learning value Learn is largely deviating from the target convergence value L1 corresponding to the magnitude of the error of the upstream-side air-fuel ratio sensor 66, it is possible to make the learning value Learn approach the target convergence value L1 promptly and thereby to make the control center air-fuel ratio AFcen approach the target air-fuel ratio (i.e., the stoichiometric air-fuel ratio AFth) promptly.

Further, the update amount D for the learning value Learn is set smaller as the inversion number M of the downstream-side air-fuel ratio sensor output value Voxs increases during the learning process (Refer to FIG. 15). Therefore, when the control center air-fuel ratio AFcen is largely deviating from the stoichiometric air-fuel ratio AFth, the control center air-fuel ratio AFcen may be made sufficiently close to the stoichiometric air-fuel ratio AFth from an early stage where the inversion number M of the downstream-side air-fuel ratio sensor output value Voxs is still small, and further, afterward, the control center air-fuel ratio AFcen may be made to gradually approach the stoichiometric air-fuel ratio AFth.

The invention is not limited to the above example embodiment, but it covers various modifications within the sprit of the invention. For example, the time period from the inversion of the downstream-side air-fuel ratio sensor output value Voxs to the accumulated value OSA reaching α, has been used as "first time period" in the foregoing example embodiment. However, it may alternatively be the time period from the inversion of the downstream-side air-fuel ratio sensor output value Voxs to the number of times of fuel injections reaching a first reference number, or the time period from the inversion of the downstream-side air-fuel ratio sensor output value Voxs to the accumulated amount of the intake air flow rate (the flow rate detected by the air-flow meter 61) reaching a first reference amount.

Further, in the foregoing example embodiment, the time period from the inversion of the downstream-side air-fuel ratio sensor output value to the accumulated value OSA reaching β has been used as "second reference period". However, it may alternatively be the time period from the inversion of the downstream-side air-fuel ratio sensor output value Voxs to the number of times of fuel injections reaching a second reference number (less than the first reference number) or the time period from the inversion of the downstream-side air-fuel ratio sensor output value Voxs to the accumulated amount of the intake air flow rate (the flow rate detected by the air-flow meter 61) reaching a second reference amount (less than the first reference amount).

Further, α, which is compared with the accumulated value OSA, is set to the value (i.e., Cmax+γ) obtained by adding the constant γ (>0, constant value) to the maximum oxygen storage capacity $C_{max}$, irrespective of the inversion number M in the foregoing example embodiment. However, γ may be set to a smaller value as the inversion number M increases. Likewise, β, which is compared with the accumulated value OSA, is set to the value (i.e., Cmax−γ) obtained by subtracting the constant γ (>0, constant value) from the maximum oxygen storage capacity $C_{max}$, irrespective of the inversion number M in the foregoing example embodiment. However, γ may be set to a smaller value as the inversion number M increases.

Further, the update amount D for the learning value Learn is set to a smaller value as the inversion number M increases in the foregoing example embodiment. However, the update amount D may be constant irrespective of the inversion number M.

Further, the control target air-fuel ratio abyfrs is set to abyfr×(1−Learn)+ΔAF during the lean (or rich) air-fuel ratio control mode of the active air-fuel ratio control in the foregoing example embodiment. However, the control target air-fuel ratio abyfrs may alternatively be set to abyfr×(1−FBsub)+ΔAF, or to abyfr×(1−SUM)+ΔAF during the lean (or rich) air-fuel ratio control mode of the active air-fuel ratio control.

Further, the integral value of the deviation SDVoxs is reset to zero each time the learning process is finished in the foregoing example embodiment. However, alternatively, the total sum of the update amounts D for the learning value Learn during the learning process may be subtracted from the integral value of the deviation SDVoxs each time the learning process is finished.

Further, the base fuel injection amount Fbase is set to the value obtained by dividing the in-cylinder intake air amount Mc by the control target air-fuel ratio abyfrs in the foregoing example embodiment. However, the base fuel injection amount Fbase may alternatively be set to a value obtained by dividing the in-cylinder intake air amount Mc by the target air-fuel ratio abyfr.

Further, in the foregoing example embodiment, the control target air-fuel ratio abyfrs is set by correcting the target air-fuel ratio abyfr (=the stoichiometric air-fuel ratio AFth) based on the sub-feedback correction amount Fbsub, and the main feedback control is performed such that the detected air-fuel ratio abyfs equals the control target air-fuel ratio abyfrs. Alternatively, the detected air-fuel ratio abyfs (or the output value Vabyfs of the upstream-side air-fuel ratio sensor) may be corrected based on the sub-feedback correction amount FBsub, and the main feedback control may be performed such that the corrected detected air-fuel ratio abyfs (or the corrected output value Vabyfs of the upstream-side air-fuel ratio sensor) equals the target air-fuel ratio abyfr (=the stoichiometric air-fuel ratio AFth).

In this case, when the active air-fuel ratio control is performed, the target air-fuel ratio abyfr is set to AFth+ΔAF during the lean air-fuel ratio control mode, and set to AFth−ΔAF during the rich air-fuel ratio control mode.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the spirit and scope of the invention.

What is claimed is:

1. An air-fuel ratio control system for an internal combustion engine, comprising:

a catalyst that is provided in an exhaust passage of the internal combustion engine and stores oxygen;

an oxygen concentration sensor that is provided downstream of the catalyst and outputs a value corresponding to an air-fuel ratio of exhaust gas flowing out from the catalyst;

an integral value calculation portion that calculates an integral value of a deviation which is updated by integrating the deviation between the value output from the oxygen concentration sensor and a reference value corresponding to a target air-fuel ratio;

an air-fuel ratio control portion that controls an air-fuel ratio of exhaust gas entering the catalyst to be equal to the target air-fuel ratio based on at least the integral value of the deviation;

a target air-fuel ratio switching portion that switches the target air-fuel ratio such that a rich target air-fuel ratio which is richer than a stoichiometric air-fuel ratio is set when the value output from the oxygen concentration sensor has been inverted from a value indicating a rich air-fuel ratio to a value indicating a lean air-fuel ratio while a lean target air-fuel ratio which is leaner than the stoichiometric air-fuel ratio is set when the value output from the oxygen concentration sensor has been inverted from the value indicating the lean air-fuel ratio to the value indicating the rich air-fuel ratio; and an integral value correction portion that corrects the integral value of the deviation when the air-fuel ratio of exhaust gas entering the catalyst is being controlled to be equal to a target air-fuel ratio switched by the target air-fuel ratio switching portion, based on whether the next inversion of the value output from the oxygen concentration sensor takes place within a predetermined time period after the value output from the oxygen concentration sensor has been inverted.

2. The air-fuel ratio control system according to claim 1, wherein the integral value correction portion has a first integral value correction portion that corrects the integral value of the deviation when the next inversion of the value output from the oxygen concentration sensor does not take place within a first time period after the value output from the oxygen concentration sensor has been inverted.

3. The air-fuel ratio control system according to claim 2, wherein the first integral value correction portion corrects the integral value of the deviation such that the air-fuel ratio of exhaust gas entering the catalyst becomes richer when the value output from the oxygen concentration sensor is not inverted from the value indicating the lean air-fuel ratio to the value indicating the rich air-fuel ratio within the first time period after the value output from the oxygen concentration sensor has been inverted from the value indicating the rich air-fuel ratio to the value indicating the lean air-fuel ratio.

4. The air-fuel ratio control system according to claim 3, wherein the first time period is a time period from when the inversion of the output of the oxygen concentration sensor from the value indicating the rich air-fuel ratio to the value indicating the lean air-fuel ratio takes place to when an accumulated value of the variation of the amount of oxygen stored in the catalyst reaches a first reference value, the accumulated value being calculated and updated from the time of the inversion on the assumption that the air-fuel ratio of exhaust gas entering the catalyst is being controlled to a target rich air-fuel ratio.

5. The air-fuel ratio control system according to claim 2, wherein the first integral value correction portion corrects the integral value of the deviation such that the air-fuel ratio of exhaust gas entering the catalyst becomes leaner when the value output from the oxygen concentration sensor is not inverted from the value indicating the rich air-fuel ratio to the value indicating the lean air-fuel ratio within the first time period after the value output from the oxygen concentration sensor has been inverted from the value indicating the lean air-fuel ratio to the value indicating the rich air-fuel ratio.

6. The air-fuel ratio control system according to claim 5, wherein the first time period is a time period from when the inversion of the output of the oxygen concentration sensor from the value indicating the lean air-fuel ratio to the value indicating the rich air-fuel ratio takes place to when an accumulated value of the variation of the amount of oxygen stored in the catalyst reaches a first reference value, the accumulated value being calculated and updated from the time of the inversion on the assumption that the air-fuel ratio of exhaust gas entering the catalyst is being controlled to a target lean air-fuel ratio.

7. The air-fuel ratio control system according to claim 2, wherein the first time period is a time period from when the inversion of the value output from the oxygen concentration sensor takes place to when the number of times of fuel injections to the internal combustion engine reaches a predetermined number.

8. The air-fuel ratio control system according to claim 3, wherein the first time period is a time period from when the inversion of the value output from the oxygen concentration sensor takes place to when an accumulated amount of the flow rate of intake air drawn into the internal combustion engine reaches a predetermined amount.

9. The air-fuel ratio control system according to claim 4, wherein the first reference value is larger than the maximum amount of oxygen that the catalyst can store.

10. The air-fuel ratio control system according to claim 6, wherein the first reference value is larger than the maximum amount of oxygen that the catalyst can store.

11. The air-fuel ratio control system according to claim 2, wherein each time the value output from the oxygen concentration sensor is inverted, the first integral value correction portion corrects the integral value of the deviation when the next inversion of the value output from the oxygen concentration sensor does not take place within the first time period after the value output from the oxygen concentration sensor has been inverted.

12. The air-fuel ratio control system according to claim 11, wherein the first integral value correction portion sets the correction amount of the integral value of the deviation to a reduced value as the number of times of inversion of the value output from the oxygen concentration sensor increases.

13. The air-fuel ratio control system according to claim 1, wherein the integral value correction portion has a second integral value correction portion that corrects the integral value of the deviation when the next inversion of the value output from the oxygen concentration sensor takes place within a second time period after the value output from the oxygen concentration sensor has been inverted.

14. The air-fuel ratio control system according to claim 13, wherein the second integral value correction portion corrects the integral value of the deviation such that the air-fuel ratio of exhaust gas entering the catalyst becomes leaner when the value output from the oxygen concentration sensor is inverted from the value indicating the lean air-fuel ratio to the value indicating the rich air-fuel ratio within the second time period after the value output from the oxygen concentration sensor has been inverted from the value indicating the rich air-fuel ratio to the value indicating the lean air-fuel ratio.

15. The air-fuel ratio control system according to claim 14, wherein the second time period is a time period from when the inversion of the output of the oxygen concentration sensor from the value indicating the rich air-fuel ratio to the value indicating the lean air-fuel ratio takes place to when an accumulated value of the variation of the amount of oxygen stored in the catalyst reaches a second reference value, the accumulated value being calculated and updated from the time of the inversion on the assumption that the air-fuel ratio of exhaust gas entering the catalyst is being controlled to a target rich air-fuel ratio.

16. The air-fuel ratio control system according to claim 13, wherein the second integral value correction portion corrects the integral value of the deviation such that the air-fuel ratio of exhaust gas entering the catalyst becomes richer when the value output from the oxygen concentration sensor is inverted from the value indicating the rich air-fuel ratio to the value indicating the lean air-fuel ratio within the second time period after the value output from the oxygen concentration sensor has been inverted from the value indicating the lean air-fuel ratio to the value indicating the rich air-fuel ratio.

17. The air-fuel ratio control system according to claim 16, wherein the second time period is a time period from when the inversion of the output of the oxygen concentration sensor from the value indicating the lean air-fuel ratio to the value indicating the rich air-fuel ratio takes place to when an accumulated value of the variation of the amount of oxygen stored in the catalyst reaches a second reference value, the accumulated value being calculated and updated from the time of the inversion on the assumption that the air-fuel ratio of exhaust gas entering the catalyst is being controlled to a target lean air-fuel ratio.

18. The air-fuel ratio control system according to claim 15, wherein the second reference value is smaller than the maximum amount of oxygen that the catalyst can store.

19. The air-fuel ratio control system according to claim 17, wherein the second reference value is smaller than the maximum amount of oxygen that the catalyst can store.

20. The air-fuel ratio control system according to claim 13, wherein each time the value output from the oxygen concentration sensor is inverted, the second integral value correction portion corrects the integral value of the deviation when the next inversion of the value output from the oxygen concentration sensor takes place within the second time period after the value output from the oxygen concentration sensor has been inverted.

21. The air-fuel ratio control system according to claim 20, wherein the second integral value correction portion sets the correction amount of the integral value of the deviation to a reduced value as the number of times of inversion of the value output from the oxygen concentration sensor increases.

22. The air-fuel ratio control system according to claim 2, wherein the integral value correction portion further includes a second integral value correction portion that corrects the integral value of the deviation when the next inversion of the value output from the oxygen concentration sensor takes place within a second time period after the value output from the oxygen concentration sensor has been inverted.

23. The air-fuel ratio control system according to claim 22, wherein each time the value output from the oxygen concentration sensor is inverted, the first integral value correction portion corrects the integral value of the deviation when the next inversion of the value output from the oxygen concentration sensor does not take place within the first time period after the value output from the oxygen concentration sensor has been inverted while the second integral value correction portion corrects the integral value of the deviation when the next inversion of the value output from the oxygen concentration sensor takes place within the second time period after the value output from the oxygen concentration sensor has been inverted.

24. The air-fuel ratio control system according to claim 23, wherein the first integral value correction portion and the second integral value correction portion set the correction amount of the integral value of the deviation to a reduced value as the number of times of inversion of the value output from the oxygen concentration sensor increases.

25. An air-fuel ratio control method for an internal combustion engine, comprising:

calculating an integral value of a deviation which is updated by integrating the deviation between a value output from an oxygen concentration sensor provided downstream of a catalyst in an exhaust passage of the internal combustion engine and a reference value corresponding to a target air-fuel ratio;

controlling an air-fuel ratio of exhaust gas entering the catalyst to be equal to the target air-fuel ratio based on at least the integral value of the deviation;

switching the target air-fuel ratio such that a rich target air-fuel ratio which is richer than a stoichiometric air-fuel ratio is set when the value output from the oxygen concentration sensor has been inverted from a value indicating a rich air-fuel ratio to a value indicating a lean air-fuel ratio while a lean target air-fuel ratio which is leaner than the stoichiometric air-fuel ratio is set when the value output from the oxygen concentration sensor has been inverted from the value indicating the lean air-fuel ratio to the value indicating the rich air-fuel ratio; and correcting the integral value of the deviation when the air-fuel ratio of exhaust gas entering the catalyst is being controlled to be equal to a switched target air-fuel ratio, based on whether the next inversion of the value output from the oxygen concentration sensor takes place within a predetermined time period after the value output from the oxygen concentration sensor has been inverted.

* * * * *